US010273666B2

(12) United States Patent
Wilson et al.

(10) Patent No.: US 10,273,666 B2
(45) Date of Patent: Apr. 30, 2019

(54) TRIM SYSTEM FOR FLUID CONTROL VALVE AND METHOD OF INSTALLING TRIM SYSTEM FOR FLUID CONTROL VALVE

(71) Applicant: Kohler Co., Kohler, WI (US)

(72) Inventors: John M. Wilson, Sheboygan, WI (US); Erich D. Slothower, Mill Valley, CA (US); Keegan J. Ford, Milwaukee, WI (US); Steven Aykens, Sheboygan Falls, WI (US); James T. Wanasek, West Allis, WI (US)

(73) Assignee: KOHLER CO., Kohler, WI (US)

( * ) Notice: Subject to any disclaimer, the term of this patent is extended or adjusted under 35 U.S.C. 154(b) by 176 days.

(21) Appl. No.: 15/596,653

(22) Filed: May 16, 2017

(65) Prior Publication Data

US 2017/0247864 A1 Aug. 31, 2017

Related U.S. Application Data

(62) Division of application No. 14/745,031, filed on Jun. 19, 2015, now Pat. No. 9,725,889.

(60) Provisional application No. 62/014,651, filed on Jun. 19, 2014.

(51) Int. Cl.
*F16L 5/00* (2006.01)
*E03C 1/02* (2006.01)

(52) U.S. Cl.
CPC ..... *E03C 1/02* (2013.01); *E03C 1/021* (2013.01); *E03C 2201/50* (2013.01); *Y10T 137/0441* (2015.04); *Y10T 137/598* (2015.04); *Y10T 137/86815* (2015.04)

(58) Field of Classification Search
CPC . E03C 1/02; E03C 1/021; E03C 1/023; F16K 11/202
See application file for complete search history.

(56) References Cited

U.S. PATENT DOCUMENTS

| | | | | |
|---|---|---|---|---|
| 1,031,391 | A | 7/1912 | Spencer | |
| 1,632,042 | A | 6/1927 | Price et al. | |
| 1,821,959 | A | 9/1931 | Bloch | |
| 2,843,150 | A | 7/1958 | Goodwin | |
| 3,770,017 | A | 11/1973 | Enterante | |
| 4,095,610 | A | 6/1978 | Priesmeyer | |
| 4,706,702 | A | 11/1987 | Grasseschi | |
| 4,756,332 | A | 7/1988 | Grasseschi | |
| 4,796,348 | A * | 1/1989 | Rosen | B23P 15/001 29/234 |
| 4,892,116 | A | 1/1990 | Grasseschi | |
| 4,896,381 | A | 1/1990 | Hutto | |
| 4,960,628 | A | 10/1990 | Stumphauzer et al. | |

(Continued)

*Primary Examiner* — Reinaldo Sanchez-Medina
(74) *Attorney, Agent, or Firm* — Foley & Lardner LLP

(57) ABSTRACT

A method for installing a trim system for a fluid control valve mounted behind a wall and configured for use with a kitchen or bath fixture. The method includes positioning a locating ring against a trim assembly, where the locating ring has an adhesive layer on a rear surface thereof; coupling the trim assembly to the fluid control valve; pushing the trim assembly and locating ring toward the wall to bond the adhesive layer of the locating ring to the wall; removing the trim assembly from the locating ring; coupling a mounting bracket to the locating ring; securing the mounting bracket to the wall; and coupling the trim assembly to the mounting bracket.

20 Claims, 23 Drawing Sheets

(56) References Cited

U.S. PATENT DOCUMENTS

| | | | | |
|---|---|---|---|---|
| 4,981,156 | A | 1/1991 | Nicklas | |
| 5,263,510 | A | 11/1993 | Heimann et al. | |
| 5,275,199 | A | 1/1994 | Howell | |
| 5,340,018 | A | 8/1994 | MacDonald | |
| 5,368,065 | A * | 11/1994 | Humpert | E03C 1/021 137/360 |
| 6,536,809 | B2 | 3/2003 | Marty et al. | |
| 6,666,227 | B2 | 12/2003 | Erickson | |
| 6,718,569 | B2 | 4/2004 | Burger et al. | |
| 6,792,629 | B2 | 9/2004 | Nelson et al. | |
| 6,802,335 | B2 | 10/2004 | Jones | |
| 6,807,983 | B1 | 10/2004 | Erickson | |
| 6,854,920 | B2 | 2/2005 | Romero | |
| 7,077,150 | B2 | 7/2006 | McNerney | |
| 7,191,476 | B1 | 3/2007 | Ko | |
| 7,191,794 | B2 | 3/2007 | Hodges | |
| 7,210,493 | B1 * | 5/2007 | Wang | E03C 1/021 137/15.01 |
| 7,509,971 | B2 | 3/2009 | Kajuch | |
| 7,802,733 | B2 | 9/2010 | Schmitt | |
| 7,942,161 | B2 | 5/2011 | Crompton | |
| 8,176,934 | B2 | 5/2012 | Niver | |
| 9,051,720 | B1 * | 6/2015 | Jones | E03C 1/042 |
| 2004/0208686 | A1 | 10/2004 | Romero | |
| 2005/0063772 | A1 * | 3/2005 | Bladen | E03C 1/021 403/348 |
| 2005/0247009 | A1 | 11/2005 | Vagedes | |
| 2010/0200077 | A1 | 8/2010 | Chan et al. | |
| 2013/0312175 | A1 | 11/2013 | Huffington et al. | |

* cited by examiner

TRIM SYSTEM FOR FLUID CONTROL VALVE AND METHOD OF INSTALLING TRIM SYSTEM FOR FLUID CONTROL VALVE

CROSS-REFERENCE TO RELATED PATENT APPLICATIONS

This application is a Divisional of U.S. patent application Ser. No. 14/745,031, filed on Jun. 19, 2015, which claims priority to and the benefit of U.S. Provisional Patent Application No. 62/014,651, filed on Jun. 19, 2014, the entire disclosures of which are incorporated by reference herein in their entireties.

TECHNICAL FIELD

The present application relates generally to the field of fluid control valves and trims systems for use with kitchen and bath fixtures. More specifically, this application relates to fluid control valves and trim systems (for fluid control valves) that are configured having multiple actuators to control the flow rate and the temperature of water flowing through the fluid control valves for use with kitchen and bath fixtures.

BACKGROUND

In conventional construction, valve bodies for certain kitchen and bath fixtures (e.g., showers, baths, spas, etc.) are generally plumbed in place prior to the finish wall being installed and, accordingly, are located behind the finish wall and are not very accessible once construction is complete. This is commonly known as "rough-in" plumbing. Accordingly, the valve body is often not parallel to the wall, and the distance from the valve body to the wall may vary from installation to installation. To compensate for these variations in angle and distance, conventional trims include a trim housing that telescopes relative to an escutcheon. Telescoping of the trim housing relative to the escutcheon changes the relative position or proportion of the trim pieces and may ruin a carefully crafted design aesthetic. Thus, there is a need for an improved system for installing trim.

SUMMARY

One embodiment relates to a trim system for a concentric fluid control valve having a first actuator and a second actuator. The trim system includes a first stem driver coupled to the first actuator of the fluid control valve, a cage coupled to the first stem driver, a first handle coupled to the cage, a second stem driver coupled to the second actuator of the fluid control valve, and a second handle coupled to the second stem driver. The first stem driver and the cage are configured to compensate for axial misalignment between the first handle and the first actuator, and the second stem driver and the second handle are configured to compensate for axial misalignment of the second handle and the second actuator.

Another embodiment relates to a trim system for controlling a fluid control valve for a kitchen or bath fixture, the fluid control valve having a first actuator configured to control one of a flow rate and a temperature of water from the valve and a second actuator configured to control the other of the flow rate and temperature of water from the valve. The trim system includes a first stem driver operatively coupled to the first actuator of the fluid control valve, a cage operatively coupled to the first stem driver, a first handle operatively coupled to the cage, a second stem driver operatively coupled to the second actuator of the fluid control valve, and a second handle operatively coupled to the second stem driver. The first stem driver and the cage are configured to compensate for axial and angular misalignment between the first handle and the first actuator, and the second stem driver and the second handle are configured to compensate for axial and angular misalignment between the second handle and the second actuator. A rotation of the first handle is configured to rotate the first actuator through the first stem driver and the cage, and a rotation of the second handle is configured to rotate the second actuator through the second stem driver. The first and second actuators may be rotated by a corresponding angular rotation relative to the rotation of the respective handle.

Another embodiment relates to a method for installing a trim system for a fluid control valve mounted behind a wall. The method includes the steps of providing a trim assembly and a locating ring, the locating ring having an adhesive layer on a rear surface thereof; coupling the trim assembly to the fluid control valve; pushing the trim assembly and locating ring toward the wall to bond the adhesive layer of the locating ring toward the wall; removing the trim assembly from the locating ring; coupling a mounting bracket to the locating ring; securing the mounting bracket to the wall; and coupling the trim assembly to the mounting bracket.

Another embodiment relates to a method for installing a trim system for a fluid control valve mounted behind a wall and configured for use with a kitchen or bath fixture. The method includes positioning a locating ring against a trim assembly, where the locating ring has an adhesive layer on a rear surface thereof; coupling the trim assembly to the fluid control valve; pushing the trim assembly and locating ring toward the wall to bond the adhesive layer of the locating ring to the wall; removing the trim assembly from the locating ring; coupling a mounting bracket to the locating ring; securing the mounting bracket to the wall; and coupling the trim assembly to the mounting bracket.

Another embodiment relates to a trim system for a fluid control valve plumbed from behind a wall. The trim system includes a trim assembly having a first handle coupled to an escutcheon. The trim system further includes a mounting assembly having a mounting bracket secured to the wall. The first handle operably couples to the fluid control valve, and the trim assembly couples to the mounting assembly.

Yet another embodiment relates to a trim system for a fluid control valve plumbed behind a wall and configured to supply a supply of water to a kitchen or bath fixture. The system includes a trim assembly having a first handle coupled to an escutcheon; and a mounting assembly having a mounting bracket that is configured to be secured to the wall. The first handle is operatively coupled to the fluid control valve, and the escutcheon is coupled to the mounting bracket.

The foregoing is a summary and thus, by necessity, contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
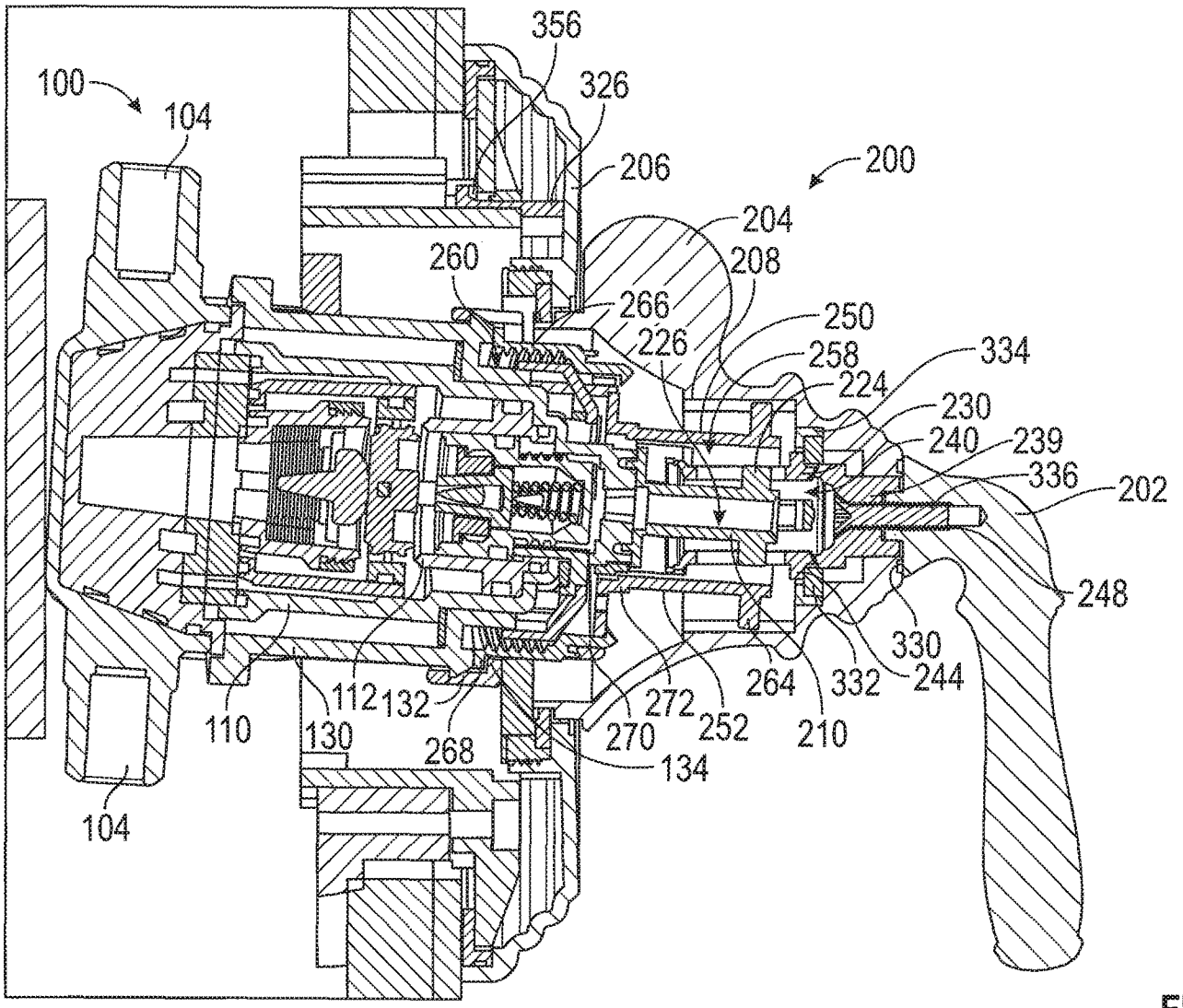
FIG. 1 is a left elevation section view of a fluid control valve and trim system, shown according to an exemplary embodiment.
Figure 2:
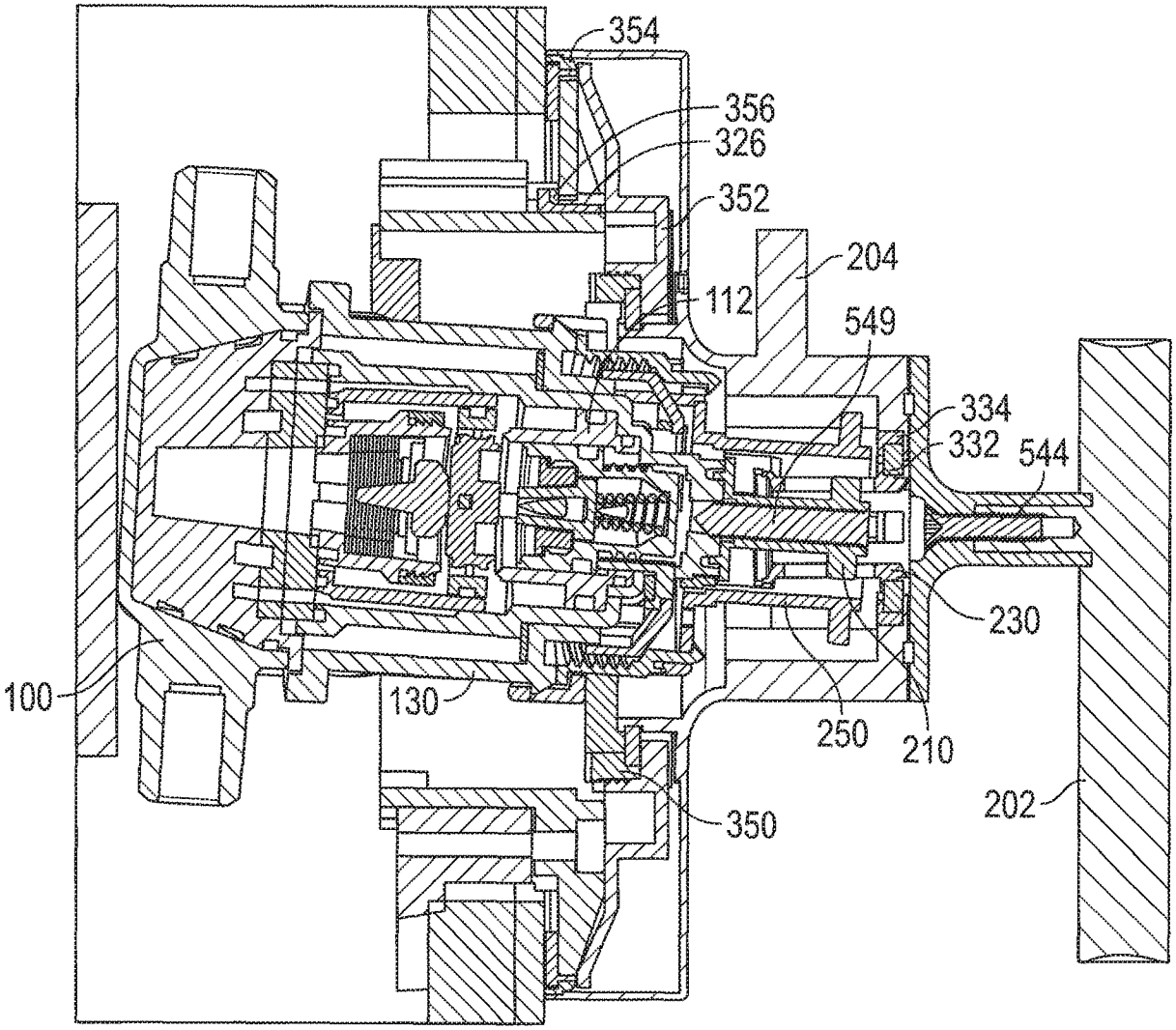
FIG. 2 is a left elevation section view of a fluid control valve and trim system, shown according to another exemplary embodiment.
Figure 4:
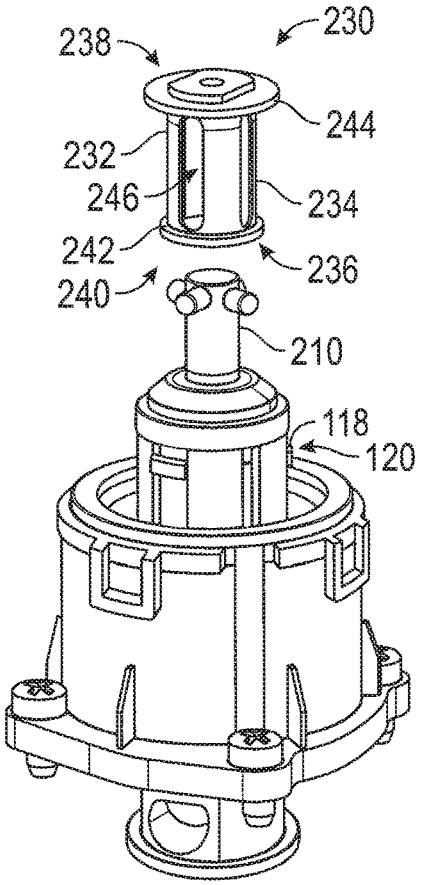
FIG. 4 is a perspective view of a fluid control valve and components of a trim system showing an exemplary embodiment of a cage coupled to the first stem driver shown in FIG. 3.
Figure 14:
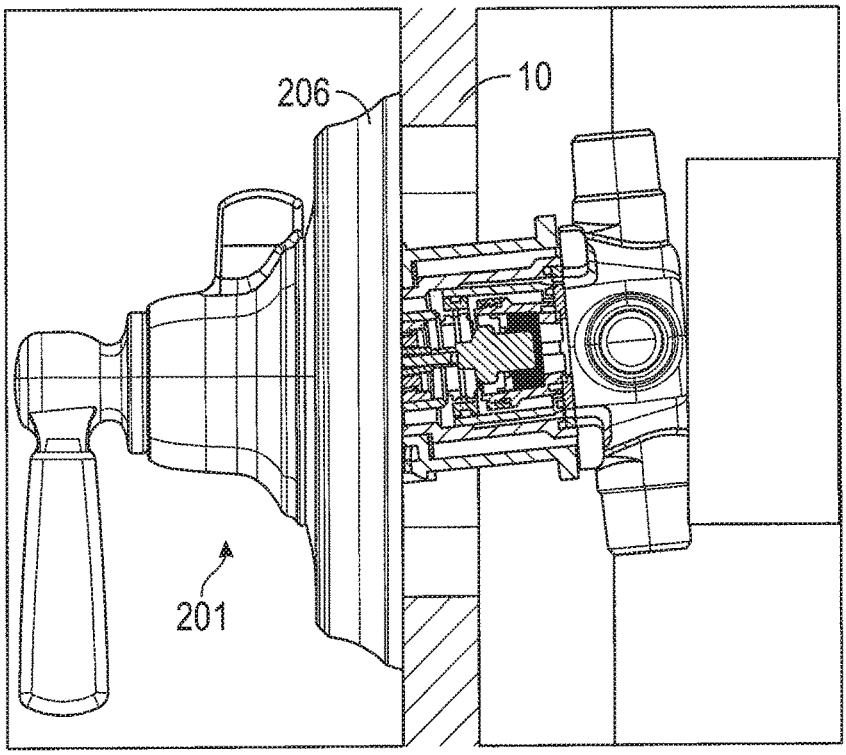
FIG. 14 is a right, partially-sectioned elevation view of a fluid control valve and a trim system assembled in place to a wall.

Referring generally to the figures, fluid control valves (e.g., fluid control valve 112), trim systems (e.g., trim system 200), and components thereof are disclosed in this application, according to various exemplary embodiments. As shown in FIGS. 1 and 2, the fluid control valves 112 are located (e.g., positioned) in valve housings 130 mounted to valve bodies 100. As shown in FIG. 4, each valve body 100 includes an input 102 configured to receive each of a hot water supply and a cold water supply, and outputs 104 for providing water from the valve body 100, for example, to bath fixtures (e.g., a spout, a showerhead, a hand sprayer, and/or a rain panel, etc.). During construction, the valve body 100 is plumbed in place prior to the wall 10 (e.g., finish wall, drywall, etc.) being installed (see FIGS. 14-15). Accordingly, the valve body 100 is often not parallel to the wall 10, and the distance from the valve body 100 to the wall 10 may vary. To compensate for these variations in angle and distance, trims may include a trim housing that telescopes relative to an escutcheon. However, telescoping of the trim housing relative to the escutcheon changes the relative position or proportion of the pieces and may ruin a carefully crafted design aesthetic.

Before discussing further details of the trim system 200 and/or the components thereof, it is noted that references to "front," "back," "rear," "upward," "downward," "inner," "outer," "right," and "left" in this description are merely used to identify the various elements as they are oriented in the FIGURES. These terms are not meant to limit any element which they describe, as the various elements may be oriented differently in various applications. Further, the term "plumb" is used relative to the front elevation view (i.e., wall elevation) of the components. "Plumb" components may not be truly plumb in the side elevation view (i.e., wall section) if the wall that the components are mounted to are not plumb.

It is further noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

FIGS. 1 and 2 illustrate two exemplary embodiments of fluid control valves 112, and trim systems 200 therefor. As shown, the fluid control valve 112 is a concentric mixing valve, meaning that the valve is generally configured to be controlled (e.g., water temperature, flow rate) about a single axis (e.g., of rotation). Also shown, the fluid control valve 112 is operated by a first handle 202 and a second handle 204, which according to an exemplary embodiment are configured to rotate about a common axis of rotation. The first handle 202 is configured to operate (e.g., control) one of a flow rate (e.g., volume of water supplied) and a temperature (e.g., of the water supplied), and the second handle 204 is configured to operate the other of the flow rate (e.g., volume) and the temperature. According to other embodiments, one of the first and second handles 202, 204 may also operate a diverter feature, such as a flow diverter, which is configured to divert the fluid flow between two or more fixtures, such as between a spout for filling a tub and a showerhead. As shown in FIGS. 1 and 2, the first handle 202 is operatively coupled (e.g., interconnected) to the fluid control valve 112 via a first stem driver 210 (e.g., first key, etc.) and a cage 230 (e.g., rotor, etc.) to influence (e.g., change) one of the flow rate and the temperature of the water flowing from one or more fixtures fluidly coupled to the fluid control valve. Also shown, the second handle 204 is coupled to the fluid control valve 112 via a second stem driver 250 to influence (e.g., change) the other of the flow rate and the temperature of the water flowing from the one or more fixtures.

Figure 3:
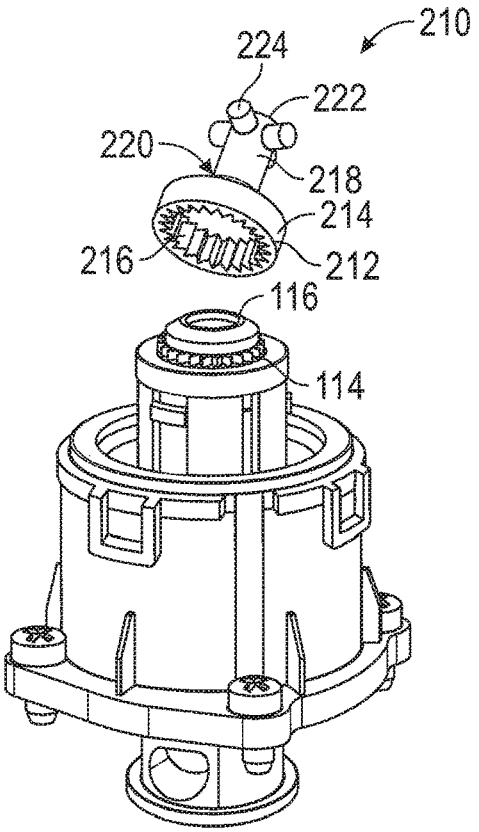
FIG. 3 is a perspective view of a fluid control valve and components of a trim system showing an exemplary embodiment of a first stem driver coupled to an exemplary embodiment of a first actuator.

FIG. 3 illustrates an exemplary embodiment of the first stem driver 210 that includes a base 212 having a sidewall 214, the inner surface of which includes a plurality of teeth 216. The teeth 216 are configured to engage teeth 114 formed on an outer perimeter of a first actuator 116 of the fluid control valve 112. This arrangement allows the first stem driver 210 to control operation of the fluid control valve 112, such as by rotation of the first stem driver 210 by way of rotation of the first handle 202. The engagement of the teeth 216, 114 acts as a clutch. For example, if the first stem driver 210 is over-torqued (i.e., subjected to a torque that exceeds a threshold torque of the valve), the teeth 216 of the first stem driver 210 are configured to fail (e.g., break, undergo a shearing failure mode, etc.) before the teeth 114 of the fluid control valve 112. Accordingly, the relatively inexpensive first stem driver 210 may be replaced, rather than having to replace other relatively more expensive components (e.g., a fluid control valve 112, a handle, etc.).

The first stem driver 210 also includes a shaft 218 that extends from a first end 220 proximate the base 212 to a second distal end 222 relative to the base 212. A plurality of lugs 224 (e.g., pins, studs, etc.) extend radially from the shaft 218 proximate the second end 222 of the shaft 218. For example, the plurality of lugs 224 may extend radially outward from an outer surface of the shaft 218. The lugs 224 are configured to engage, for example, the cage 230 (e.g., slots therein), such that rotation of the cage 230 rotates the first stem driver 210 through the lugs 224.

The first stem driver 210 may be rotatably retained relative to the valve cartridge 110 by way of a clip (e.g., snap, etc.). In place of or in addition to the clip, the first stem driver 210 may be fastened to the first actuator 116 of the fluid control valve 112 to prevent accidental decoupling of the first stem driver 210 and the fluid control valve 112. For example, a screw or other fastener may be used to fasten the first stem driver 210 to the first actuator 116, such as by passing through a bore 226 in the first stem driver 210 and threading into a threaded bore in the first actuator 116.

FIG. 4 illustrates an exemplary embodiment of the cage 230 that includes an elongated body 232 having a sidewall 234, a first flange 242, and a second flange 244. The sidewall 234 extends axially from a first end 236 of the body 232 to a second end 238 of the body 232, and the sidewall 234 defines a cavity 240 therein. The first flange 242 extends radially outward from the sidewall 234 at the first end 236, and the second flange 244 extends radially outward from the sidewall 234 at the second end 238. A plurality of slots 246 extend axially in the sidewall 234 (e.g., through the sidewall 234 to the cavity 240). The plurality of slots 246 are spaced-apart circumferentially around the body 232. Each slot 246 may extend radially outward and axial through a portion of the first flange 242 to allow the cage 230 to be assembled to the first stem driver 210 by passing the lugs 224 of the first stem driver 210 through the portion of the first flange 242 having the slot 246 until the lugs 224 are located between the first and second flanges 242, 244 (see FIGS. 1 and 5).

Figure 6:
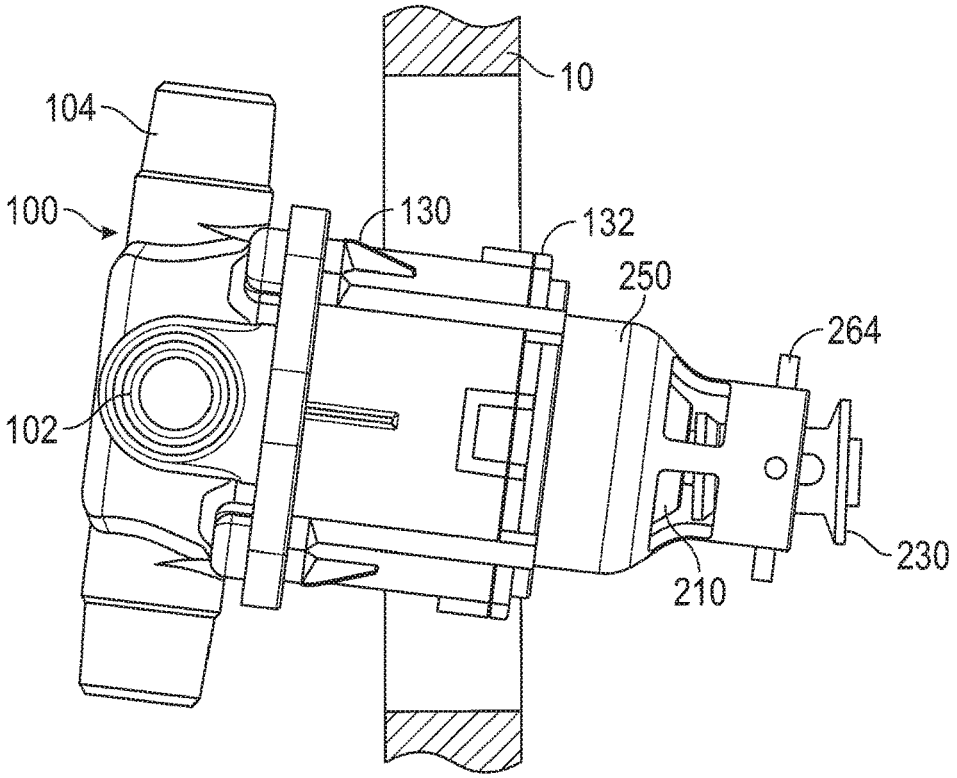
FIG. 6 is a left elevation view of the system shown in FIGS. 3-5 coupled to a valve body and a wall.
Figure 7:
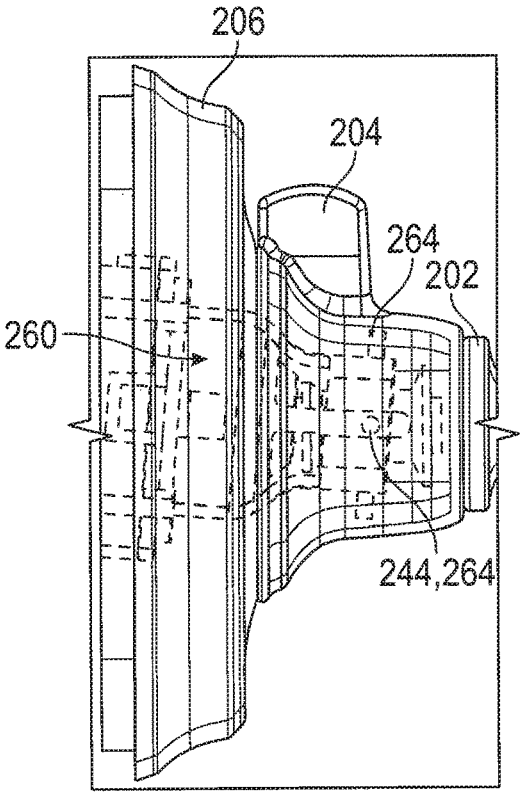
FIG. 7 is a left elevation view of the system shown in FIGS. 3-5 with exemplary embodiments of handles and an escutcheon coupled the system.

Referring to FIGS. 6 and 7, it should be understood that while the cage 230 and first stem driver 210 are described with terms such as "axially" and "radially," the interaction of the lugs 224 of the first stem driver 210 and the slots 246 of the cage 230 allow rotation of the cage 230 to cause (e.g., drive) rotation of the first stem driver 210 even if the axis of the cage 230 and axis of the first stem driver 210 are neither collinear nor parallel, such as aligned at an angle relative to one another. For example, the interaction of the first stem driver 210 and the cage 230 may compensate for an angular misalignment of up to approximately 5 degrees. Moreover, the length of the slots 246 in the cage 230 allows the cage 230 to translate generally axially relative to the first stem driver 210, such as during assembly. Accordingly, the configuration of the cage 230 also compensates for variation in the distance (e.g., axial misalignment) between the valve body 100 or fluid control valve 112 and the first handle 202 (see FIG. 1). For example, the configuration of the cage 230 and the first stem driver 210 may compensate for a variable distance (e.g., a range of distances) between the valve body 100 and the wall 10, in view of varying thicknesses of the wall 10, the type of fluid control valve 112 (e.g., thermostatic, pressure balanced, diverter, etc.), and a variable axial thickness of the escutcheon 206 and/or second handle 204. Further, it is contemplated that two or more first stem drivers 210 having shafts 218 of different or varying lengths may be provided with a trim system 200 (e.g., as part of an installation kit) to provide for a myriad of variation possibilities, while only providing one or two extra low-cost pieces. As non-limiting examples, the first stem driver 210 and/or the cage 230 may be formed of a plastic (e.g., via injection molded, etc.), a metal (e.g., brass, stainless steel, etc.), a composite, a ceramic, combinations thereof, or any suitable material.

Figure 12:
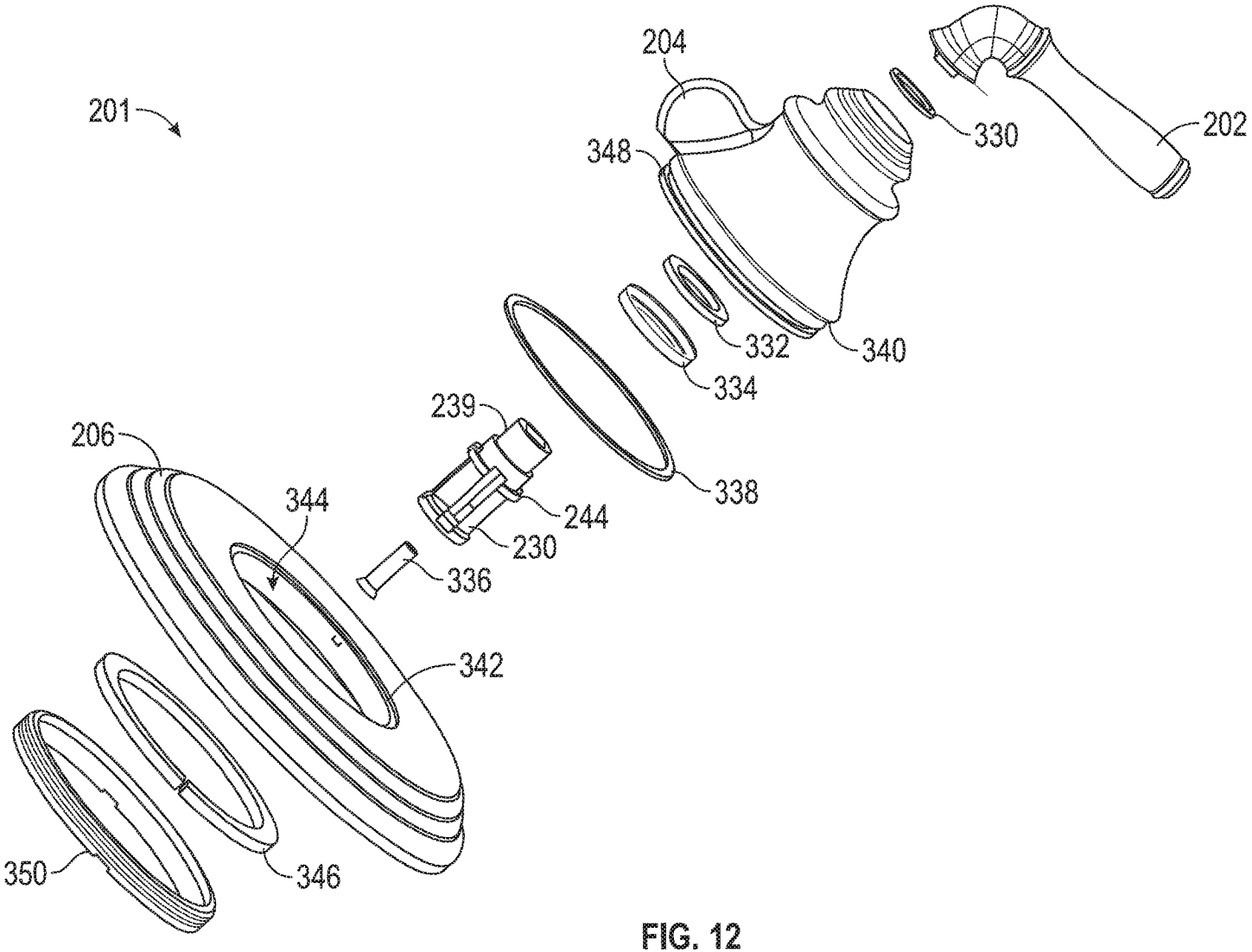
FIG. 12 is an exploded perspective view of the trim assembly shown in FIG. 1.

As shown in FIGS. 1 and 12, the cage 230 may include an extension 239 disposed on the second end 238 of the body 232 and configured to be coupled to the first handle 202. For example, the cage 230 may be secured, fixed, or permanently fixed to the first handle 202. As shown in FIG. 1, the extension 239 of the cage 230 is disposed in a bore of the second handle 204 and includes a bore through which a fastener 336 engages the first handle 202 to couple the cage 230 to the first handle 202. The shaft of the fastener 336 threads to a threaded bore in the first handle 202, and a the head of the fasteners 336 is configured to retain the extension 239 in place relative to the fastener 336 and the first handle 202. Accordingly, the second handle 204 may be trapped (e.g., constrained) between the first handle 202 and the cage 230 (e.g., the second flange 244 thereof). As will be described below with respect to FIG. 12, one or more bearings may be located between the first handle 202 and the second handle 204 and/or the second flange 244 of the cage 230 and the second handle 204 to permit relative rotation of the first handle 202 and the cage 230 relative to the second handle 204.

As shown in FIGS. 1 and 2, the second handle 204 is interconnected to the fluid control valve 112 via the second stem driver 250 (e.g., a second key, etc.). For example, the second stem driver 250 shown in FIG. 5 may be coupled to a second actuator of the fluid control valve 112, such as the second actuator 120 shown in FIG. 4. The second stem driver 250 includes a sidewall 252 extending from a first end 254 of the second stem driver 250 axially to a second end 256 of the second stem driver 250, and at least partially defining a cavity 258 therein. The first end 254 of the second stem driver 250 defines a first opening 260 (see FIG. 7), and the second end 256 of the second stem driver 250 defines a second opening 262 (see FIG. 5). A plurality of lugs 264 extends radially from the sidewall 252 proximate the second end 256 of the second stem driver 250. For example, each lug 264 extends radially outward from the sidewall 252 in order to engage a feature (e.g., a slot, opening, etc.) in the second handle 204, such that rotation of the second handle 204 rotates the second stem driver 250 through the lugs 264.

Figure 5:
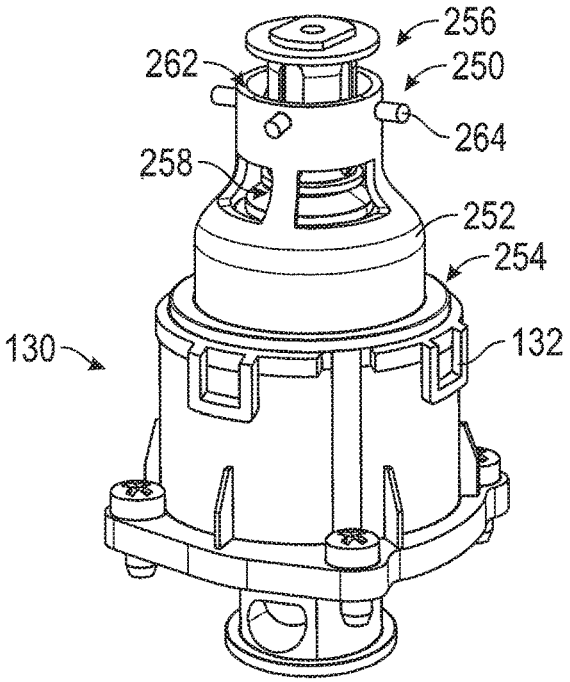
FIG. 5 is a perspective view showing an exemplary embodiment of a second stem driver coupled to the system shown in FIG. 4.

As shown best in FIGS. 1 and 5, the second stem driver 250 may be rotatably coupled (e.g., retained) to the valve housing 130, for example, by a retaining clip 132. The retaining clip 132 is configured to selectively (e.g., detachably) couple to the valve housing 130 and includes a radially inwardly extending flange 134 that retains (e.g., traps) an outwardly extending flange 268 at the first end 254 of the second stem driver 250. It is noted that according to one embodiment (see FIGS. 3-7), the second stem driver 250 may be a single piece that is formed, for example, by the injection molding of plastic. According to another embodiment (see, e.g., FIGS. 1-2), the second stem driver 250 may be formed of a first piece 270 and a second piece 272 that are coupled together. As shown in FIGS. 1 and 2, the first piece 270 and the second piece 272 may be clipped together, snapped together, or otherwise coupled together. The second stem driver 250 may be formed of a plastic (e.g., via injection molded, etc.), a metal (e.g., brass, stainless steel, etc.), a composite, a ceramic, combinations thereof, or any suitable material.

An inner surface of the sidewall 252 (see FIG. 5) includes at least one structure 266 (see FIG. 1) that is configured to engage complementary structures 118 (shown in FIG. 4) to couple the second stem driver 250 and the second actuator 120 together. Each structure 266 may include, for example, threads, grooves, ridges, teeth, etc., which engage the associated structure 118, which are provided on an outer perimeter of the second actuator 120 of the fluid control valve 112. According to the exemplary embodiment shown in FIG. 5, the second stem driver 250 may extend at least partially around the valve cartridge 110.

When assembled, as shown in FIG. 5, the first stem driver 210 and the cage 230 are located within the cavity 258 of the second stem driver 250, and the cage 230 extends axially through the second opening 262 in the second end 256 of the second stem driver 250. According to another embodiment, the second end 222 of the first stem driver 210 may extend axially through the second opening 262 in the second end 256 of the second stem driver 250. According to the exemplary embodiment shown in FIG. 1, the lugs 224 of the first stem driver 210 are substantially aligned with the lugs 264 of the second stem driver 250. For example, each lug 224 of the first stem driver 210 may be aligned radially (e.g., collinearly) with one lug 264 of the second stem driver 250.

Also shown in FIG. 1, an interior surface of the second handle 204 defines a plurality of channels 208 (e.g., slots, grooves, recesses, etc.), where each channel is configured to receive a corresponding (e.g., associated) lug 264 from the second stem driver 250. Accordingly, rotation of the second handle 204 may cause rotation of the second stem driver 250 (by way of the engagement of the lug 264 and the associated channel 208) even though the axes of rotation of the second handle 204 and the second stem driver 250 are not collinear or parallel. Moreover, the length of the channels 208 in the second handle 204 allow the second handle 204 to translate generally axially relative to the lugs 264 of the second stem driver 250 during assembly. Accordingly, the configuration of the second handle 204 and the second stem driver 250 may compensate for variation in the distance between the various components, such as the valve body 100 or fluid control valve 112 and the second handle 204. For example, the configuration of the second handle 204 and the second stem driver 250 may compensate for the distance between the valve body 100 and the wall 10, the thickness of the wall 10, the type of fluid control valve 112, and the axial thickness of the escutcheon 206 and/or second handle 204. It is contemplated that two or more second stem drivers 250 having sidewalls 252 of different lengths may be provided with a trim system 200 (e.g., as part of an installation kit) to provide for a myriad of variation possibilities, while only providing one or two extra low-cost pieces.

Figure 8:
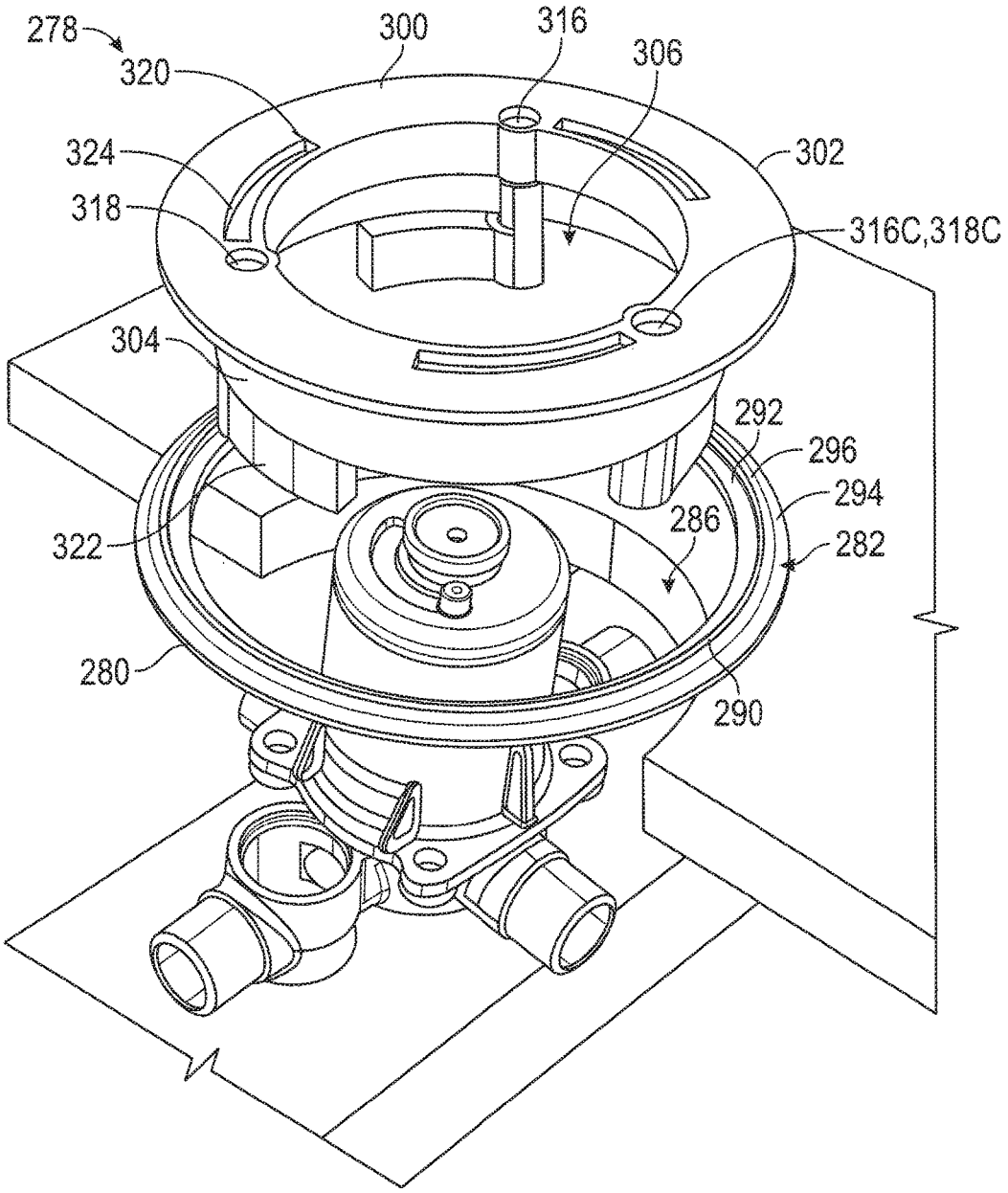
FIG. 8 is a front perspective exploded view of a fluid control valve and components for use with the systems of FIGS. 1 and 2.
Figure 9:
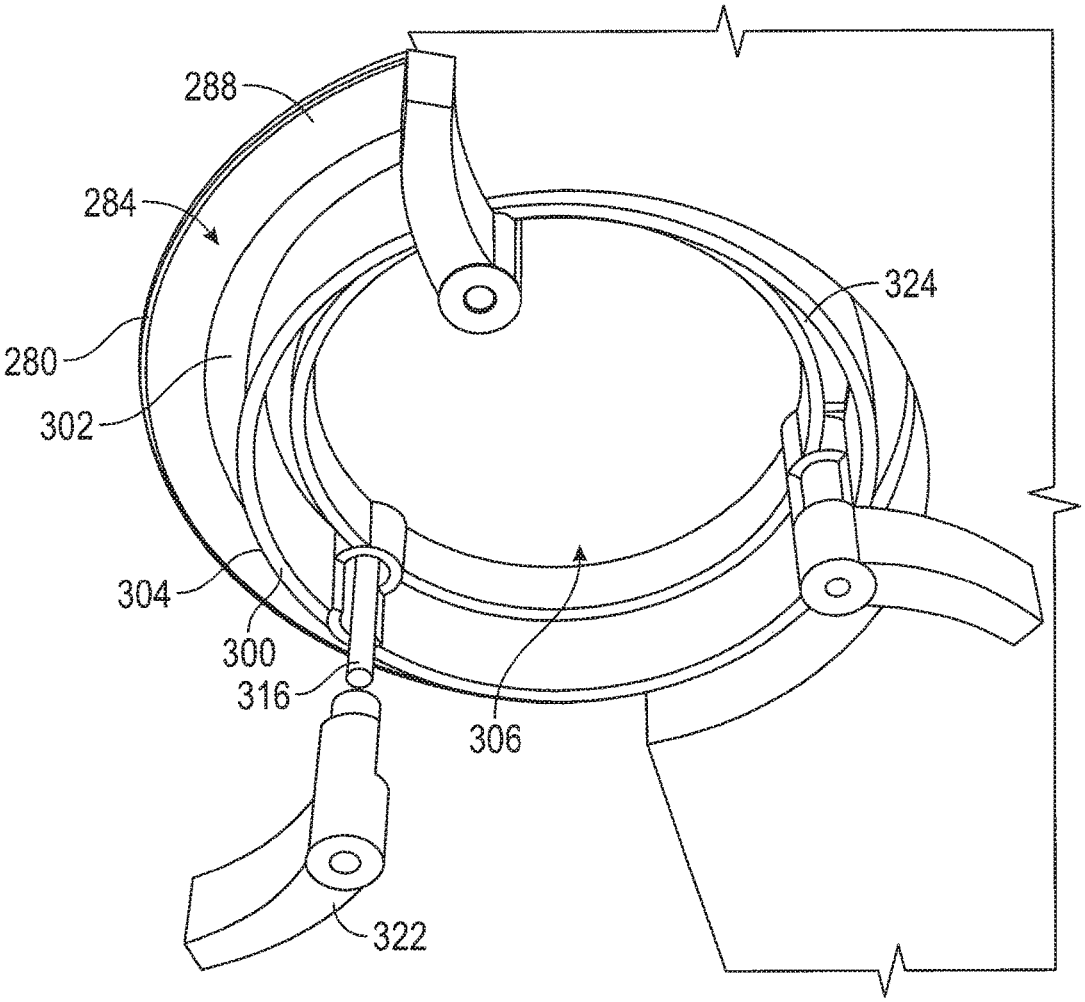
FIG. 9 is a rear perspective view of components for use with the systems of FIGS. 1 and 2.

FIGS. 8 and 9 illustrate an exemplary embodiment of a mounting assembly 278 for use with the trim system 200. As shown, the mounting assembly 278 includes a locating ring 280 and a mounting bracket 300. According to the exemplary embodiment shown, the locating ring 280 is substantially annular having a first side 282 (e.g., front side, etc.) and a second side 284 (e.g., rear side, back side, etc.), which is opposite the first side 282 and configured to be located adjacent the wall 10. The locating ring 280 defines an opening 286 that extends through the locating ring 280 and is configured to receive the mounting bracket 300.

The mounting assembly 278 may include an adhesive layer. As shown in FIG. 9, the second side 284 of the locating ring 280 includes an adhesive layer 288 configured to couple the locating ring 280 to the wall 10. The adhesive of the layer 288 is configured to have sufficient adhesion (e.g., stickiness, tackiness, etc.), such that when the locating ring 280 is coupled to the wall 10, the locating ring 280 will not move while the rest of the mounting assembly 278 is mounted to the wall 10. However, the adhesive is also configured such that the locating ring 280 may be removed from the wall 10, such that the locating ring 280 may be repositioned if improperly placed. According to other embodiments, the locating ring 280 may be coupled to the wall 10 using other suitable coupling techniques (e.g., double-sided tape, suction cups, etc.).

Figure 10:
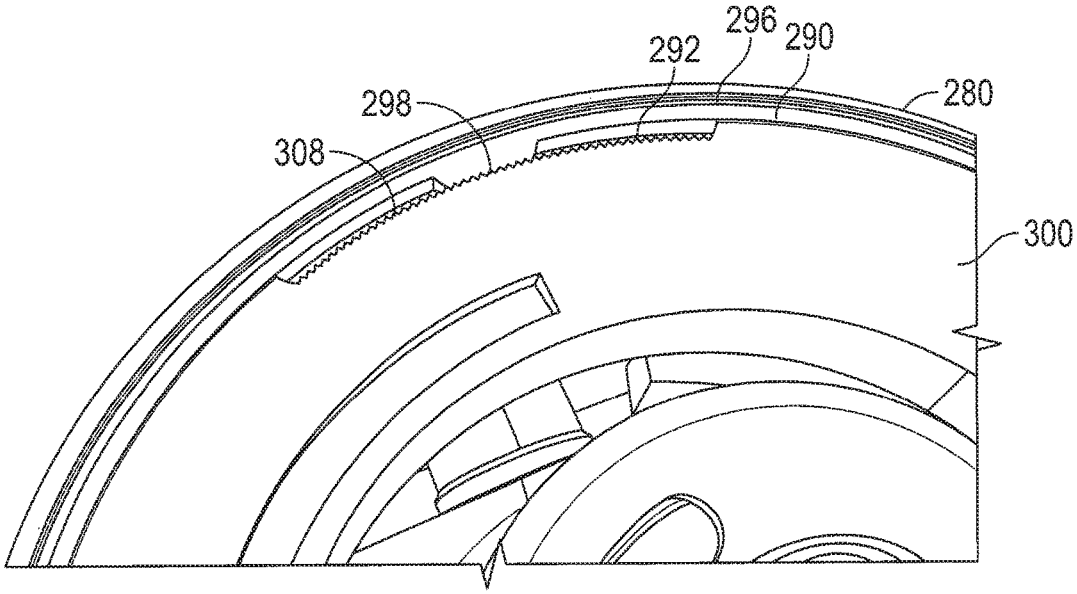
FIG. 10 is an enlarged perspective view of components for use with the systems of FIGS. 1 and 2.

As shown in FIGS. 8 and 10, the first side 282 of the locating ring 280 includes a ridge 290 extending from the first side 282 of the locating ring 280 away from the second side 284 of the locating ring 280 (e.g., axially). Thus, the ridge 290 may be annular shaped. Accordingly, the first side 282 of the locating ring 280 is divided into an inner flange surface 292, extending radially inward from the ridge 290, and an outer flange surface 294, extending radially outward from the ridge 290. The inner flange surface 292 is configured to be located (e.g., trapped, clamped, positioned, etc.) behind the mounting bracket 300, between the mounting bracket 300 and the wall 10, when the mounting bracket 300 is installed. The mounting assembly 278 may include a seal between the locating ring 280 and the mounting bracket 300. As shown in FIGS. 8 and 10, a seal 296 is provided and configured to extend circumferentially about the locating ring 280 adjacent to a radially outer side of the ridge 290 on the outer flange surface 294. The ridge 290 and the seal 296 may be included on locating rings 280 used, for example, for mounting assemblies 278 used in shower environments. The ridge 290 and the seal 296 may divert water around the opening 286 and prevent water from entering the opening 286 and working its way behind the wall 10.

As shown in FIGS. 8 and 9, the mounting bracket 300 includes a radially extending flange 302 and a sidewall 304 extending axially from the flange 302 and at least partially defining an opening 306, which extends through the mounting bracket 300. The mounting bracket 300 is configured such that a radially outer periphery of the flange 302 is seated within the ridge 290 of the locating ring 280. As shown in FIG. 10, the mounting bracket 300 includes one or more radially outward extending teeth 308 configured to engage the radially inward extending teeth 298 of the locating ring 280. The interaction of the teeth 308 of the mounting bracket 300 and the teeth 298 of the locating ring 280 allow the mounting bracket 300 to be positioned and/or repositioned until the mounting bracket 300 is in a properly installed (e.g., plumb, aligned, etc.) position, such as the position shown in FIG. 19. Thus, the teeth 298, 308 may prevent relative rotation between the locating ring 280 and the mounting bracket 300 once installed into the correct relative position.

Figure 11:
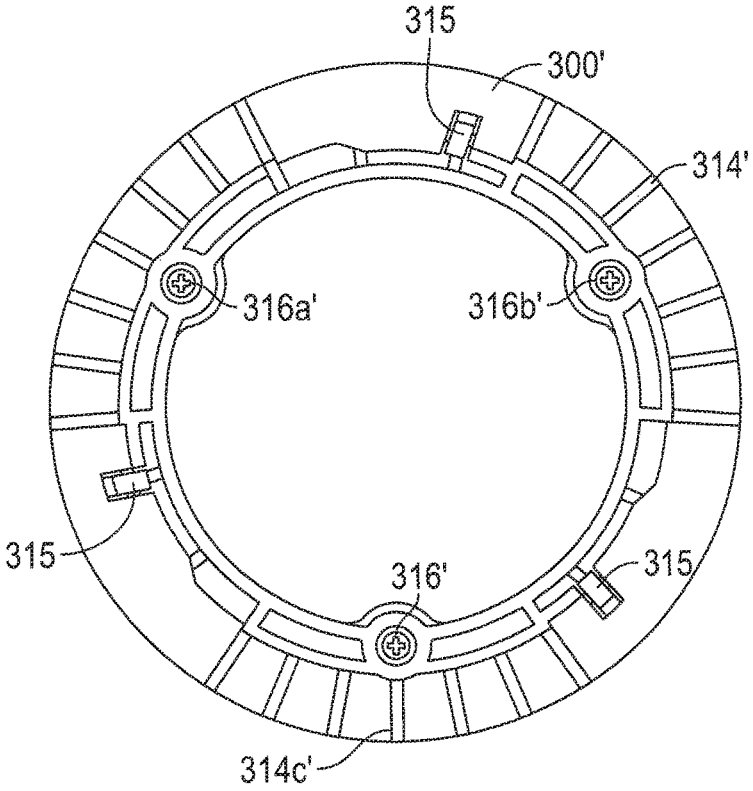
FIG. 11 is a front elevation view of a trim component for use with the systems of FIGS. 1 and 2.
Figure 17:
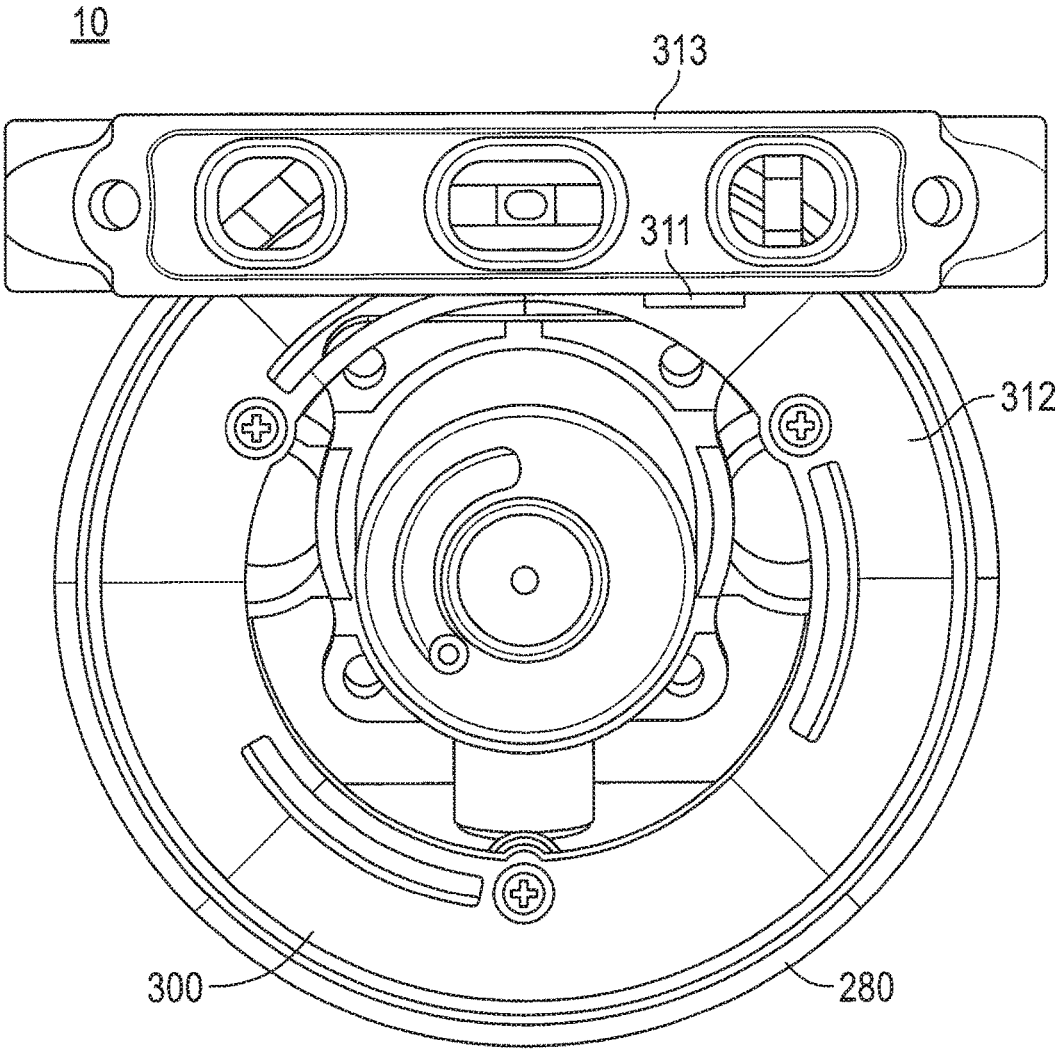
FIG. 17 is a front elevation view of a fluid control valve and components of a trim system shown with a mounting bracket.

The mounting bracket 300 may include one or more features configured to facilitate alignment of the mounting bracket 300 into a properly installed position. As shown in FIG. 17, a ledge 311 may be formed on a front side 312 of the mounting bracket 300 such that when a level 313 is placed upon the ledge and oriented to plumb, the mounting bracket 300 will be in the aligned position. As shown in FIG. 11, one or more reinforcing ribs 314' on the frontal surface of the mounting bracket 300' may be oriented to provide a visible alignment feature such that when the one or more reinforcing ribs 314' are aligned to a level orthogonal to plumb, the mounting bracket 300' will be in the aligned position. As shown in FIG. 8, two or more mounting screws 316 and/or mounting screw holes 318 may be positioned on the mounting bracket 300 such that when the two or more mounting screws 316 and/or mounting screw holes 318 are aligned to a level orthogonal to plumb, the mounting bracket 300 will be in the aligned position. Referring still to FIG. 8, according to another embodiment, a mounting screw hole 318*c* and/or a mounting screw 316*c* (not shown, but configured to be received within the mounting screw hole 318*c*) may be positioned radially opposite a marking 320 (e.g., line, groove, ridge, reinforcing rib, indicator, etc.) such that when the marking 320 and the mounting screw 316*c* and/or mounting screw hole 318*c* are aligned to a level oriented to plumb, the mounting bracket 300 will be in an aligned position.

Also shown in FIG. 11, three mounting screws 316' are positioned at 120 degrees apart relative to one another. A first and a second of the three mounting screws 316*a*', 316*b*' are oriented relative to the mounting bracket 300' such that when the first mounting screw 316*a*' and the second mounting screw 316*b*' are level, the mounting bracket 300' is aligned to a properly installed position. As shown, one of the reinforcing ribs 314*c*' is oriented relative to the mounting bracket 300' such that when the mounting bracket 300 is aligned in a properly installed position the reinforcing rib is plumb. According to another exemplary embodiment, four mounting screws may be positioned at 90 degrees apart relative to each adjacent mounting screw. For example, two screws may be aligned along a vertical axis and two screws may be aligned along a horizontal axis, thereby providing an installer with two axes to properly orient the mounting bracket. It is noted that the above described aligning features are examples of such features, and other types of aligning features may be used in the systems of this application. It is also noted that each system may, optionally, include any one or combination of these aligning features.

With reference back to FIGS. 8 and 9, each mounting screw 316 extends through the mounting bracket 300 to couple to an anchor wing 322 to secure the mounting bracket 300 (and retaining ring 280) in place relative to the wall 10. Each anchor wing 322 extends radially relative to, and from, a mounting screw 316. In a shipping position (see e.g., FIG. 8), the anchor wings 322 extend circumferentially relative to the sidewall 304 of the mounting bracket 300. When the mounting bracket 300 is in the properly installed position, the mounting screws 316 may be backed out (e.g., turned counterclockwise), and the anchor wings 322 may be rotated to a position extending substantially radially outward relative to the mounting bracket 300 behind the wall 10 through which the mounting bracket 300 passes. The mounting screws 316 may then be tightened (e.g., turned clockwise, driven, etc.) such that the mounting bracket 300 is secured to the wall 10 by trapping (e.g., clamping, etc.) the wall 10 between the anchor wing 322 and the flange 302 of the mounting bracket 300.

The mounting bracket 300 includes one or more features for coupling the trim assembly 201 (e.g., first handle 202, second handle 204, escutcheon 206, etc.) to the mounting bracket 300. For example, the mounting bracket 300 may include one or more circumferentially extending slots 324 (FIG. 8), where each slot 324 is configured to receive a finger 326 (see FIGS. 1 and 2) from the trim assembly 201 to allow the trim assembly 201 to be rotated to a locked (e.g., installed, mounted, etc.) position. Accordingly, the trim assembly 201 may be easily mounted to the mounting bracket 300, and in turn to the wall 10, with a twist and lock motion. Mounting the trim assembly 201 to the wall 10, as opposed to the valve housing 130 and/or the valve body 100, advantageously causes excess loads (e.g., side loads, etc.) to be transferred to the wall 10 rather than to the plumbing system, thereby reducing loading on the plumbing system, which in turn reduces the potential for leaks and improves both the durability and the longevity of the fluid control valve 112 and trim system 200.

FIG. 12 illustrates an exemplary embodiment of a trim assembly 201 that includes a first handle 202, a second handle 204, an escutcheon 206, and a cage 230. The trim assembly 201 may also include one or more washers, bearings, or other similar elements. For example, a bearing washer 330 may be located between the first handle 202 and the second handle 204, such as to allow relative rotation between the handles with little or no friction and/or prevent fluid from passing through.

Also for example, a bearing 332 and a bearing retainer 334 may be located between the second flange 244 of the cage 230 and the second handle 204, such as to allow relative rotation between the second handle 204 and the cage 230 with little or no friction and/or prevent fluid from passing through. The cage 230 and the first handle 202 are coupled together, trapping the bearing washer 330, the second handle 204, the bearing 332, and the bearing retainer 334 between the cage 230 and the first handle 202. According to the example shown in FIG. 12, the cage 230 and the first handle 202 are rotationally fixed to one another via the screw 336, but are rotatable relative to the second handle 204.

Also for example, a bearing ring 338 (e.g., washer) may be located between a lip 340 on the second handle 204 and lip 342 on the inner periphery of the escutcheon 206. Thus, the lips 340, 342 may oppose one another to trap the bearing washer 338 between the second handle 204 and the escutcheon 206. The bearing ring 338 facilitates rotation of the second handle 204 relative to the escutcheon 206 and may inhibit fluid from passing between the second handle 204 and the escutcheon 206 through the opening 344 defined therethrough.

Also for example, a bearing, shown in FIG. 12 as a split ring bearing 346 (e.g., split ring), may be located between a rear face of the escutcheon 206 and a flange 348 at the rear end of the second handle 204. A retainer 350 couples to the escutcheon 206 to retain the split ring bearing 346 to the escutcheon 206. According to the embodiment shown, the retainer 350 is threaded to the rear of the escutcheon 206. The split ring bearing 346 facilitates rotation of the second handle 204 relative to the escutcheon 206.

Figure 13:
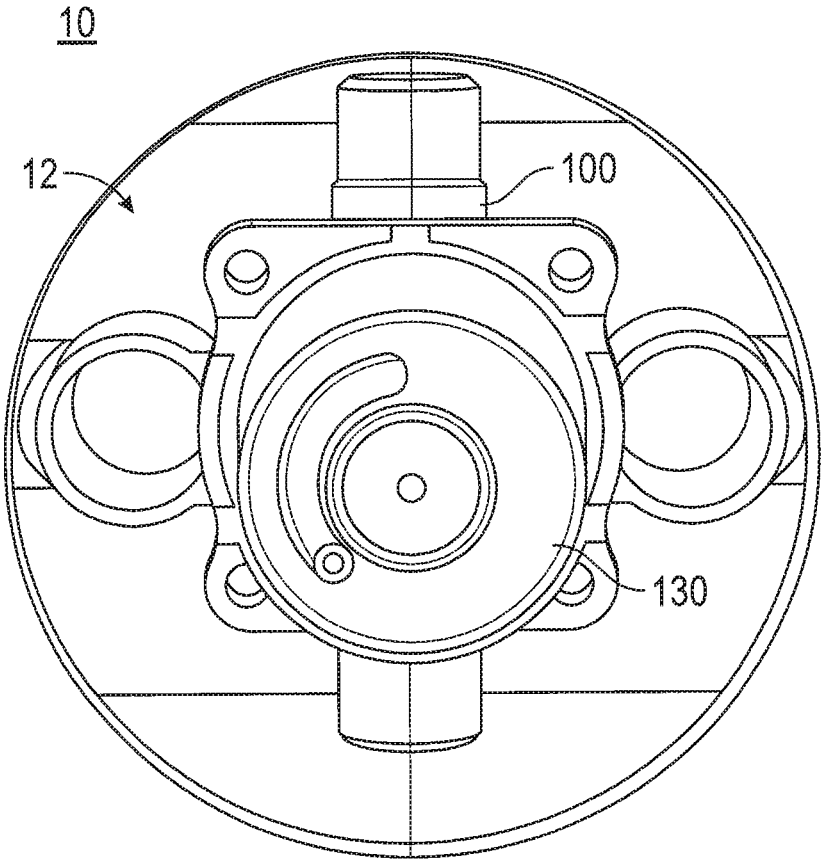
FIG. 13 is a front elevation view of an exemplary embodiment of a fluid control valve for use with the systems of FIGS. 1 and 2.

Referring generally to FIGS. 13-22, installation of a trim system 200 for a fluid control valve will now be described, according to an exemplary embodiment. With reference to FIG. 13, the valve housing 130 and the valve body 100 should be visible through a rough-in hole 12 in the wall 10. As previously discussed, the valve body 100, and inlet lines (not shown) to and from the valve body 100, are plumbed in place prior to installation of the wall 10, and the fluid control valve 112 and valve housing 130 have subsequently been installed to the valve body 100. As discussed above with reference to FIGS. 3-5, because the first stem driver 210 and the second stem driver 250 compensate for any misalignment between the valve body 100 and the wall 10 and/or the trim assembly 201, the trim assembly 201 (e.g., first handle, second handle, escutcheon, cage, etc.) may be provided to the installer as one assembly. The installer may receive a kit including the trim assembly 201, the locating ring 280, the mounting bracket 300, and one or more of each of the first and second stem drivers 210, 250.

With reference back to FIG. 1, the first stem driver 210 and the second stem driver 250 are coupled to the fluid control valve 112 and/or the valve housing 130. The locating ring 280 is positioned on the rear side of the escutcheon 206, and a protective layer (e.g., paper, waxed paper, plastic, film, etc.) is removed from the adhesive layer 288 on the rear side of the locating ring 280. The trim assembly 201 is then mounted to the first and second stem drivers 210, 250, and the escutcheon 206 is then pushed against the wall 10 until the adhesive from the locating ring 280 bonds the locating ring 280 to the wall 10 (see FIG. 14).

Figure 15:
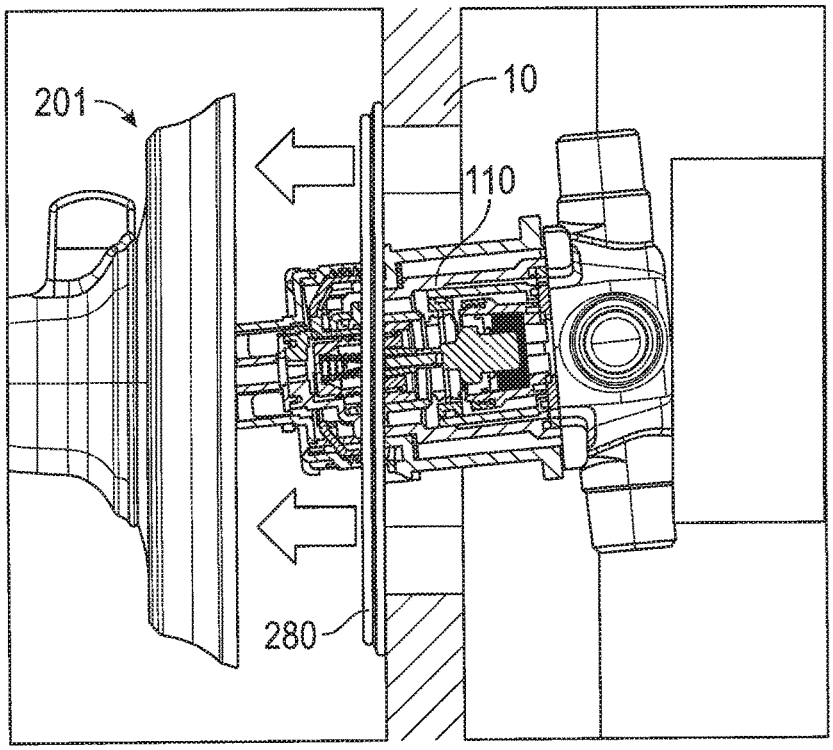
FIG. 15 is a right, partially-sectioned elevation view of the fluid control valve and the trim system shown in FIG. 14 partially assembled to the wall.
Figure 16:
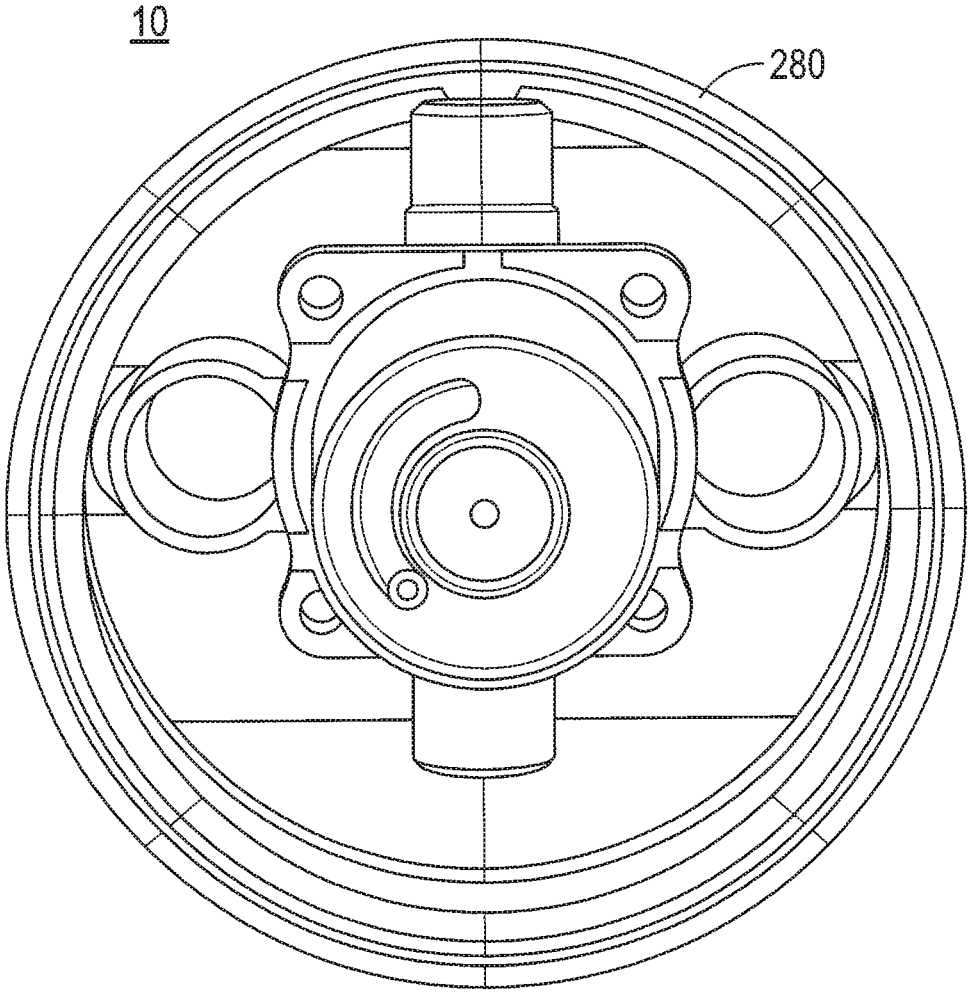
FIG. 16 is a front elevation view of a fluid control valve and components of a trim system.

With reference to FIGS. 15 and 16, the trim assembly 201 is then pulled away from the wall 10 leaving the locating ring 280 attached to the wall 10. This preliminary assembly properly locates the locating ring 280, such that the trim assembly 201, as installed, advantageously does not cause side loading on the valve cartridge 110 and/or valve stems. Side loading on the valve stems may cause the first handle 202 and/or second handle 204 to bind and be difficult to operate. Side loading on the valve stems may also cause premature wear and damage to the valve cartridge 110. The locating ring 280 may be removed and repositioned as necessary to properly position the locating ring 280.

Figure 18:
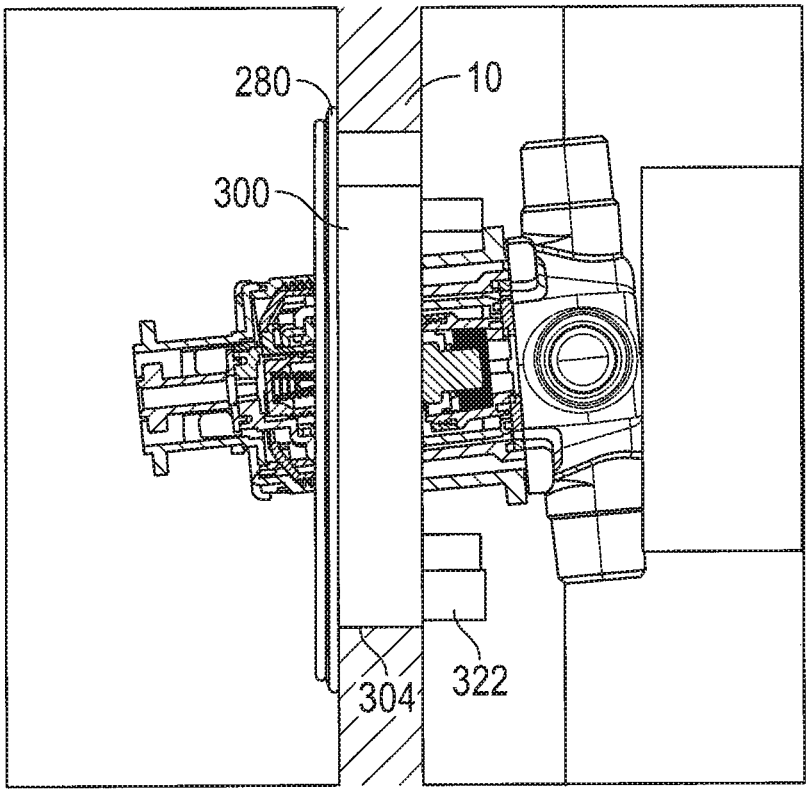
FIG. 18 is a right, partially-sectioned elevation view of a fluid control valve and a trim system.

With reference to FIGS. 17 and 18, the mounting bracket 300 is positioned in the locating ring 280, such that the sidewall 304 of the mounting bracket 300 extends at least partially through the wall 10. The mounting bracket 300 is then oriented to an installed position. For example, a level (e.g., the level 313) or plumb bob may be used by the installer to ensure that the mounting bracket 300 is properly aligned, such as to vertical or horizontal.

Figure 19:
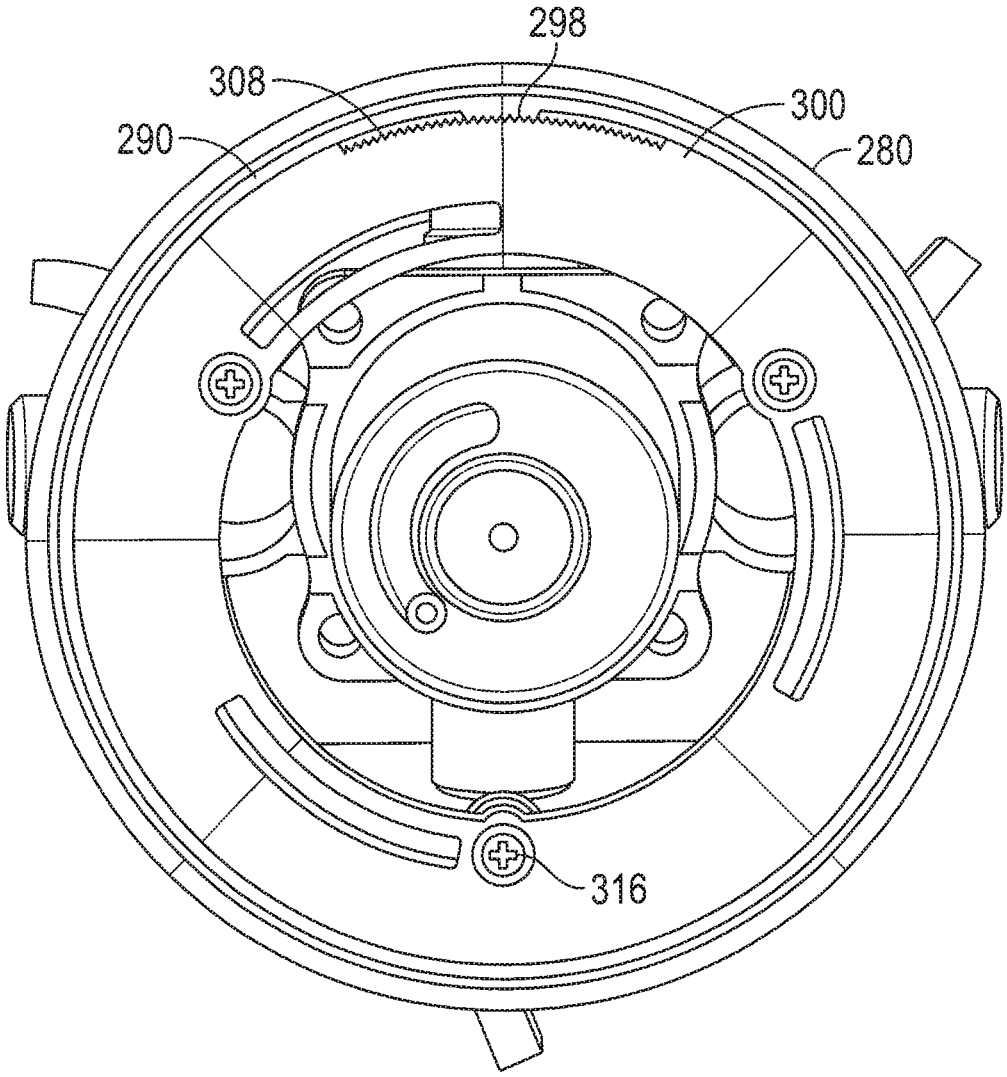
FIG. 19 is a front elevation view of a fluid control valve and components of a trim system.
Figure 20:
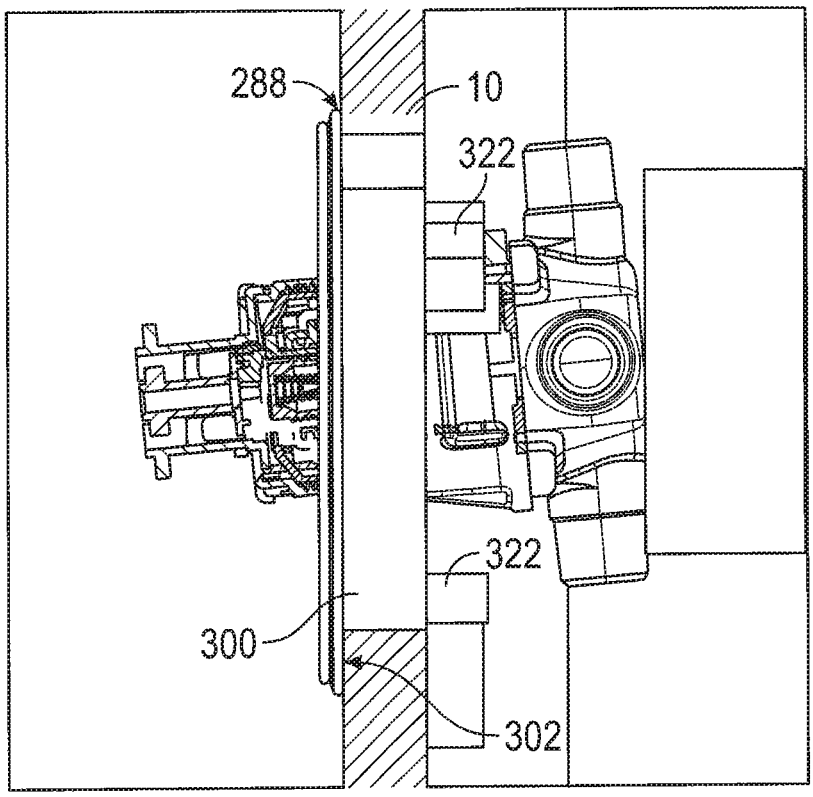
FIG. 20 is a right, partially-sectioned elevation view of a fluid control valve and a trim system.

With reference to FIG. 19, the teeth 298 on the inner periphery of the ridge 290 of the locating ring 280 may engage the teeth 308 on the outer periphery of the mounting bracket 300, thereby retaining the mounting bracket 300 in a proper orientation. The mounting screws 316 may be backed out (e.g., loosened) and then drove in (e.g., tightened) to move the anchor wings 322 from a shipping position (see FIG. 18) to an installed position (see FIG. 20) and to clamp the wall 10 between the anchor wings 322 and the flange 302 of the mounting bracket 300 to secure the mounting bracket 300 to the wall 10.

When the mounting screws 316 are tightened, some of the reactive torque is resisted by the adhesive layer 288 coupling of the locating ring 280 to the wall 10. For example, the reactive torque may be transferred across the mounting bracket 300 to the teeth 308 on the outer periphery thereof, to the teeth 298 on the inner periphery of the locating ring 280, and through the adhesive layer 288 to the wall 10. Accordingly, the trim system 200 resists the mounting bracket 300 being moved out of position during tightening of the mounting screws 316, which may otherwise misalign the mounting bracket 300 relative to the wall 10.

Figure 21:
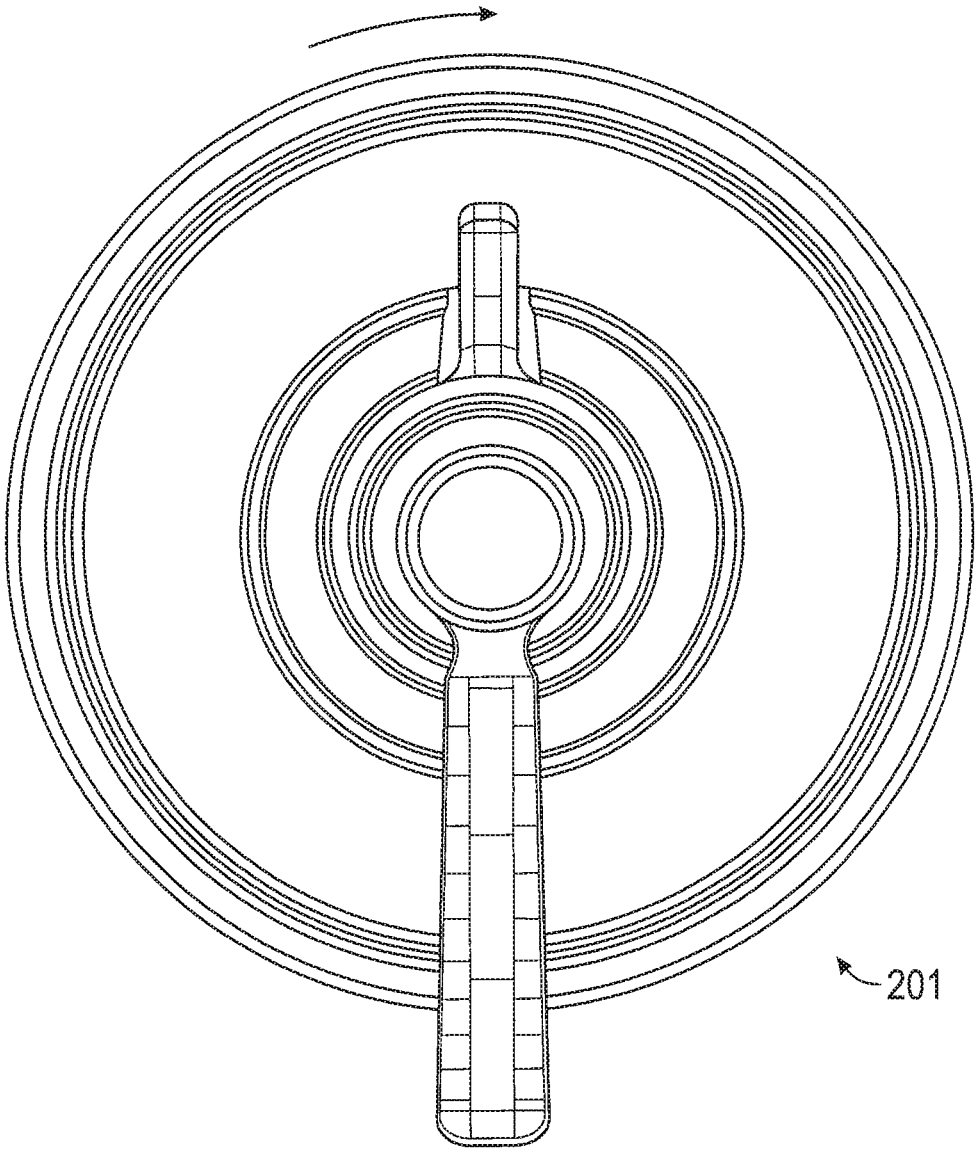
FIG. 21 is a front elevation view of a trim system.

With reference to FIGS. 1 and 21, the trim assemblies 201 are again mounted to the fluid control valve 112 (e.g., via the first stem driver 210 and the second stem driver 250) and the mounting bracket 300. The fingers 326 on the rear side of the escutcheon 206 are passed through the circumferential slots 324 (see FIG. 8) in the mounting bracket 300, and the first and second stem drivers 210, 250 are coupled to the cage 230 and the second handle 204, respectively. The escutcheon 206 is then rotated so that the fingers 326 engage the mounting bracket 300, thereby securing the trim assembly 201 to the mounting bracket 300 (see FIGS. 1 and 2). According to one exemplary embodiment, the escutcheon 206 is rotated approximately 15 to 30 degrees until fingers 326 stop against the end of the slots 324 of the mounting bracket 300. A tab feature 356 located near the slots 324 in the mounting bracket 300 may act as a detent or help lock the fingers 326 in place to prevent the trim from being inadvertently rotated and pulled off the wall 10 during operation. The escutcheon 206 may be removed from the mounting bracket 300 for service or for upgrading the trim (e.g., the trim assembly 201) and/or valve cartridge 110.

The fingers 326 on the rear side of the escutcheon 206 may be oriented relative to the trim assembly 201, such that when the escutcheon 206 is rotated into an installed position, the escutcheon 206 ends up in an aesthetically pleasing position. For example, a name (e.g., corporate name, manufacturer, etc.), logo, and/or insignia may be plumb and/or level when the escutcheon 206 is rotated into the installed position. Because the slots 324 of the mounting bracket 300 may be in a predetermined position based on the mounting bracket 300 being in a plumb installed position, the escutcheon 206 is configured to end up in a properly installed position after being inserted relative to the mounting bracket 300 based on the location of the fingers 326 on the rear surface of the escutcheon 206.

Referring to another embodiment shown, for example in FIG. 2, the fingers 326 may be located on the rear of an attachment plate 352 rather than on the rear of the escutcheon 206. An escutcheon may then be held in place relative to the attachment plate 352, the mounting bracket 300, or the locating ring 280, such as, for example, utilizing friction, an interference fit, a fastener, an adhesive, a combination thereof, or in another suitable manner. As shown in FIG. 2, the escutcheon (e.g., escutcheon 206) is configured to compress or deflect a seal 354 about the periphery of the locating ring 280. In an embodiment having an attachment plate 352, the retainer 350 may be coupled to the attachment plate 352 rather than directly coupled to the escutcheon 206.

Figure 22:
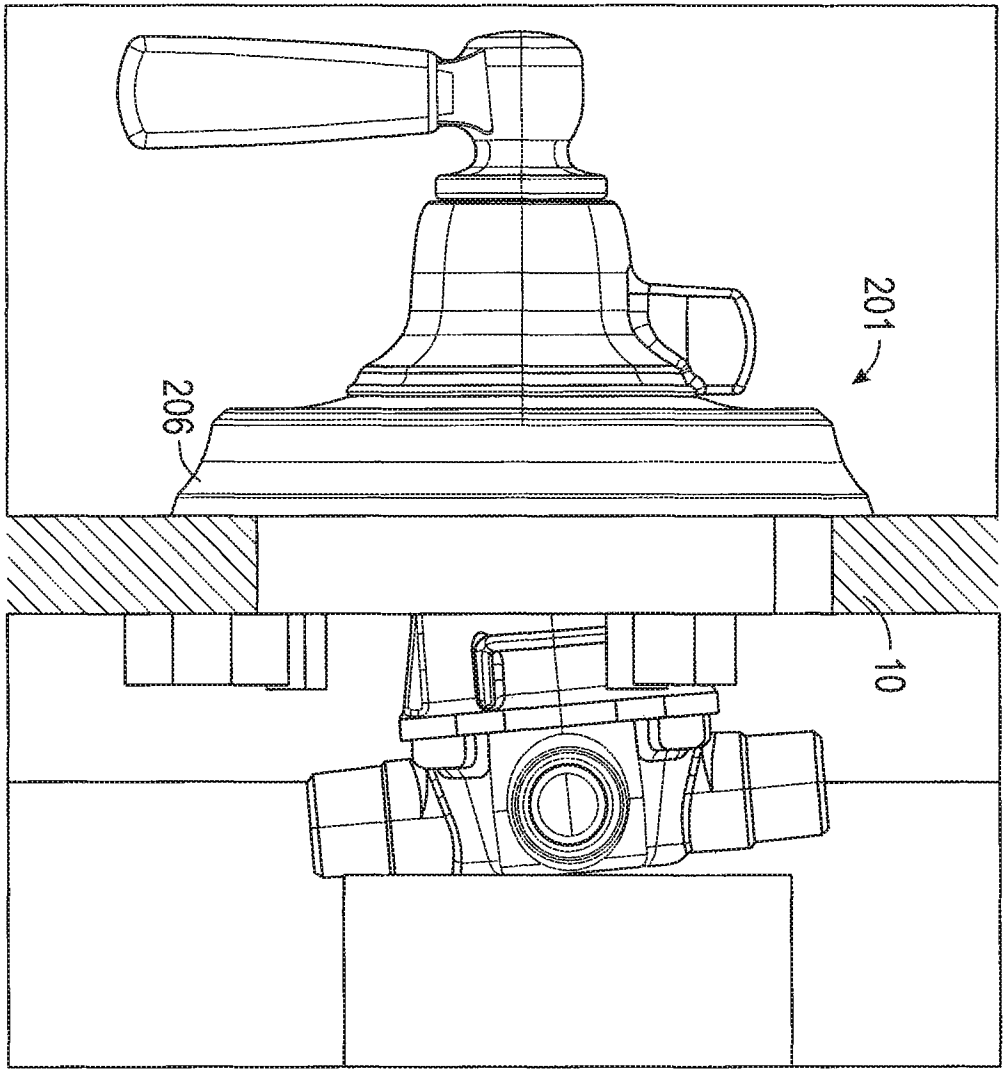
FIG. 22 is a right elevation view of a fluid control valve and a trim system.

FIG. 22 illustrates the trim assembly 201 in the fully installed position, in which the trim assembly 201 is mounted flush to the wall 10, thereby presenting a more aesthetically pleasing view. In this position, the escutcheon 206 may contact (e.g., abut) the wall 10, such that there is no gap between the escutcheon 206 and the wall 10 to form a seal therebetween to inhibit water from flowing through the rough-in hole 12 in the wall 10. However, if there is a gap between the escutcheon 206 and the wall 10, then the gap is smaller and more consistent from a size perspective around the profile/periphery.

Figure 23:
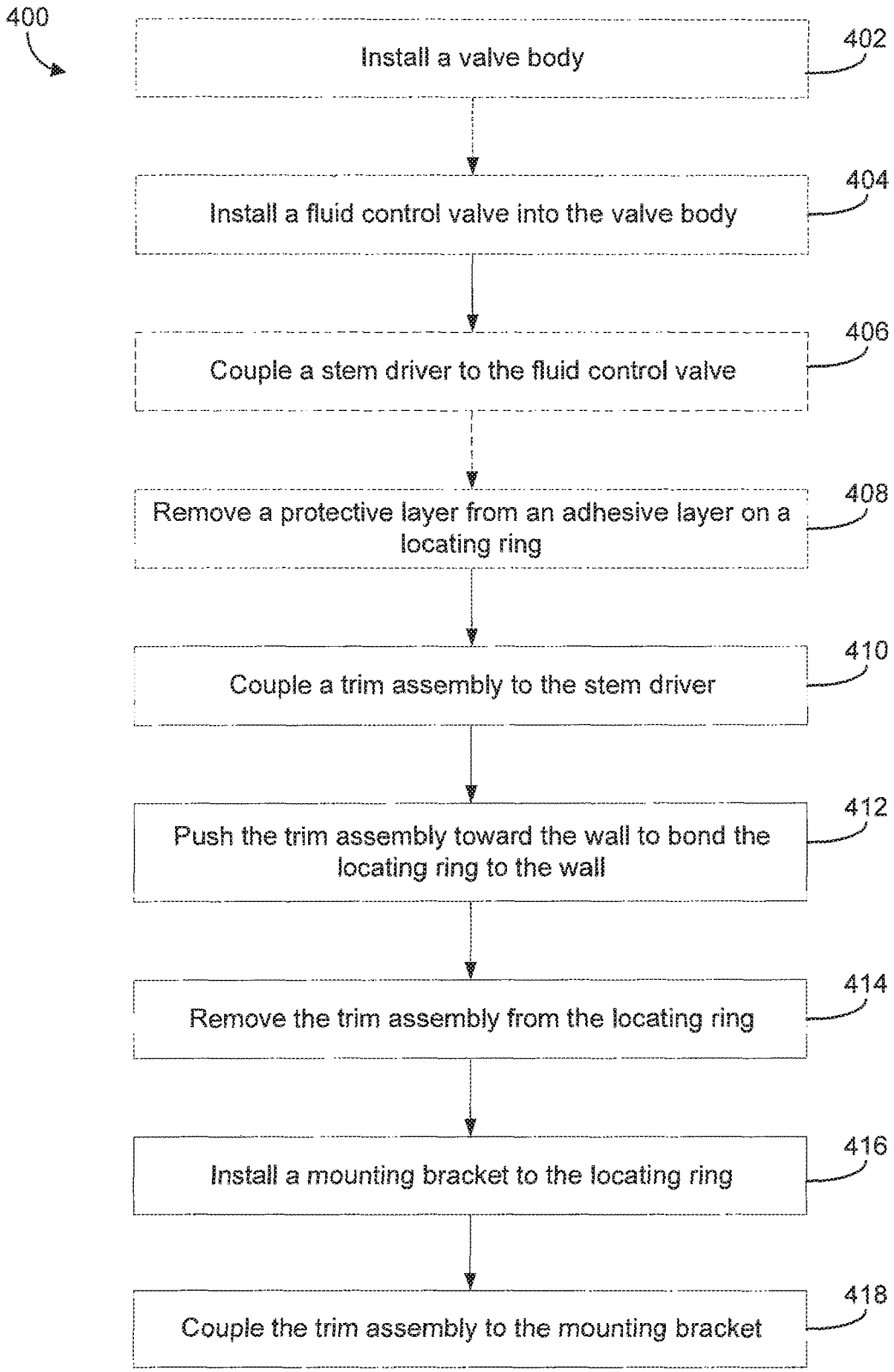
FIG. 23 is a flowchart of a process for installing a trim system for a fluid control valve.

FIG. 23 shows an exemplary embodiment of a flowchart of a process 400 for installing a trim system 200 for a fluid control valve. The process 400 may include the steps of installing a valve body (step 402), installing a fluid control valve into the valve body (step 404), and coupling a stem driver to the fluid control valve (step 406). A locating ring having an adhesive thereon may be provided with a trim assembly. Thus, the process 400 may include an additional step between steps 406 and 408 involving positioning a locating ring on a trim assembly (not shown). The process 400 may include the step of removing a protective layer from the adhesive layer on the locating ring (step 408), if provided. The process 400 includes the steps of coupling a trim assembly to the stem driver (step 410), pushing the trim assembly toward the wall to bond the locating ring to the wall (step 412), removing the trim assembly from the locating ring (step 414), installing a mounting bracket to the locating ring (step 416), and coupling the trim assembly to the mounting bracket (step 418).

FIGS. 24-27 illustrate another exemplary embodiment of a fluid control valve and trim system 500 that includes a trim assembly 501 and a fluid control valve. The fluid control valve and trim system 500 is configured to mount to a wall 10. As shown, the fluid control valve is configured as a concentric mixing valve. The fluid control valve may be configured the same as the fluid control valve 112 described above for the concentric mixing valve, except where noted. However, it is noted that the fluid control valve may be configured as a sequential mixing valve. For this example, a sequential mixing valve system would need only a single handle, which may be the same as, similar to, or different than either the first handle 502 or the second handle 504. A similar mounting system, as disclosed elsewhere in this application, could be employed with the sequential mixing valve and single handle.

Figure 24:
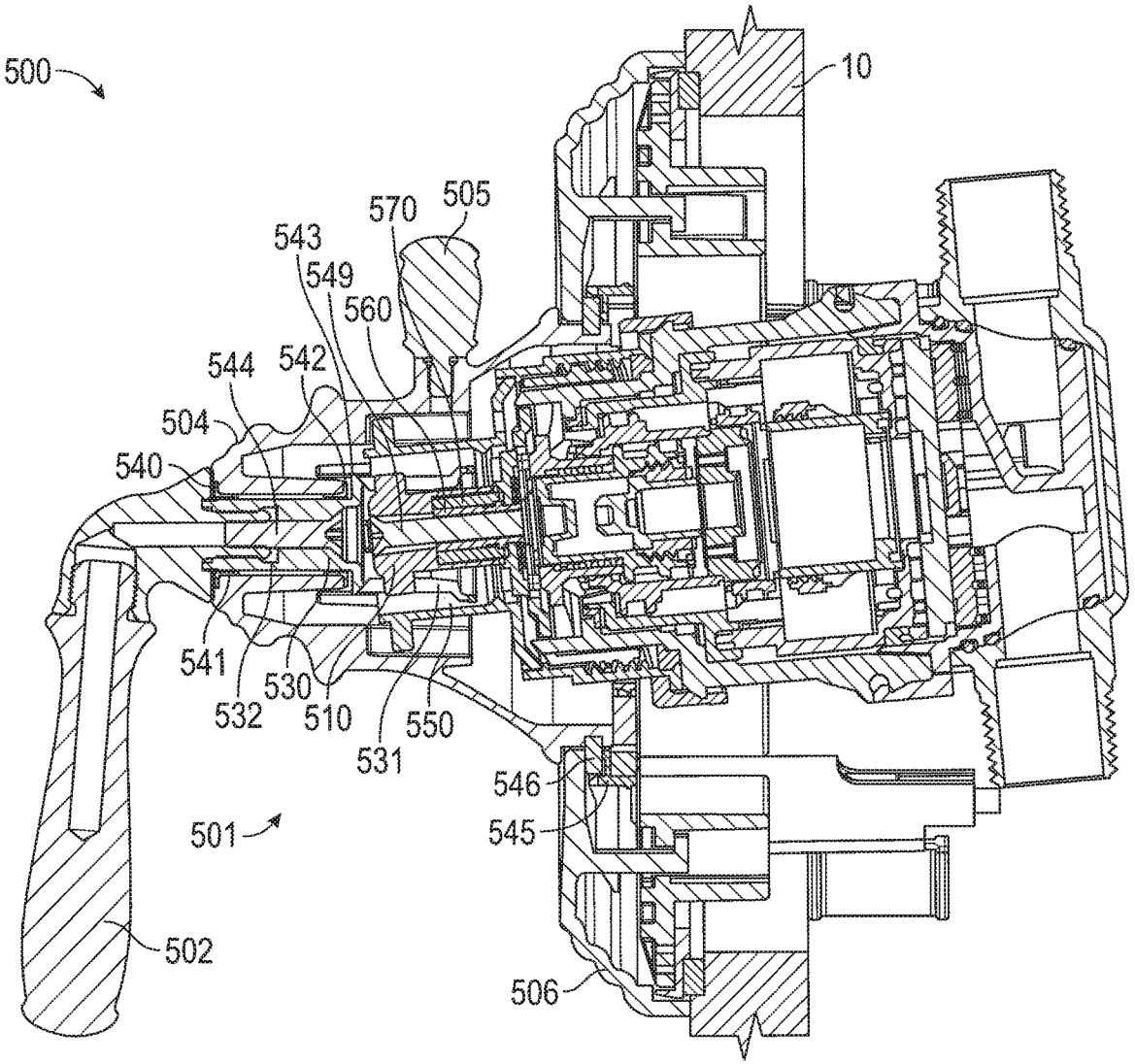
FIG. 24 is a section view of another exemplary embodiment of a fluid control valve and trim system shown mounted to a wall.

As shown in FIG. 24, the fluid control valve includes a first stem driver 510, a valve stem 560, and an adapter 570. The valve stem 560 is configured to control an operation of the fluid control valve, such as a flow rate or a temperature of water flowing therethrough. For example, the valve stem 560 may be coupled to a first actuator of the fluid control valve, such that rotation of the valve stem 560 rotates the first actuator to control the flow rate or the temperature. As shown best in FIG. 26, the valve stem 560 includes a base coupled to the first actuator and a shoulder extending from the base. According to one example, the base is generally annular shaped and the shoulder is generally cylindrically shaped. The shoulder of the valve stem 560 may include a bore, such as to receive a fastener 549. An outer surface of the shoulder of the valve stem 560 is configured to be coupled to the adapter 570.

Figure 26:
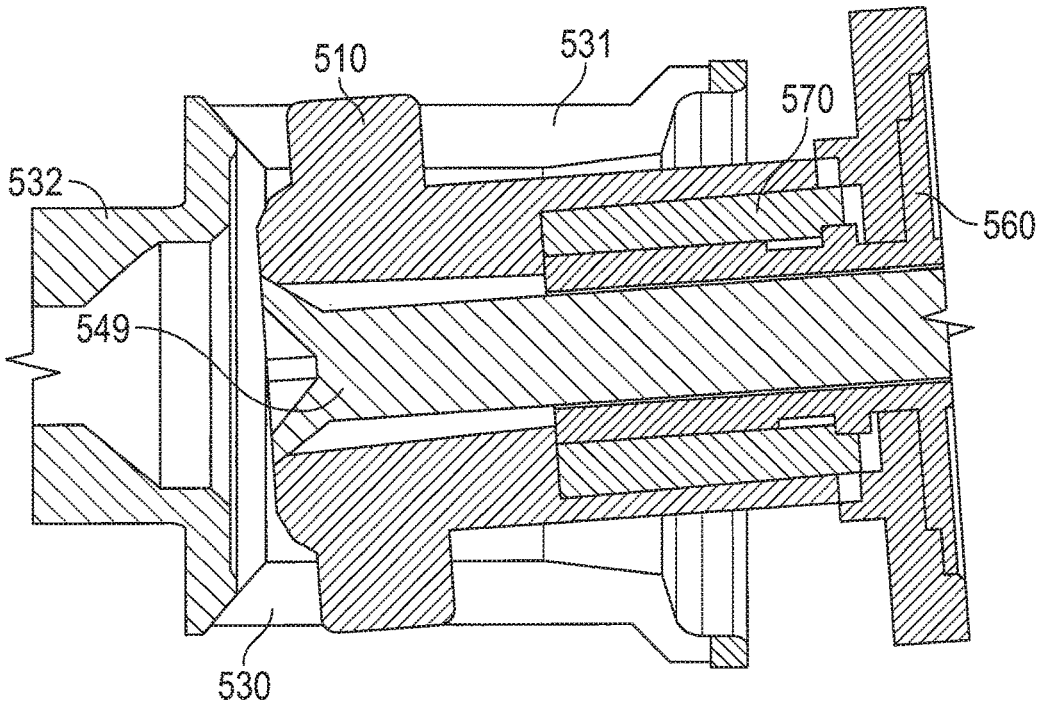
FIG. 26 is a detail view of a portion of the fluid control valve and trim system shown in FIG. 24.

The first stem driver 510 is configured to drive rotation of the valve stem 560 when rotated, such as by a cage 530, which may be driven in-turn by the first handle 502. The first stem driver 510 may be configured the same as the first stem driver 210, except where noted. The first stem driver 510 includes a bore that extends from a first end to a second end. As shown in FIGS. 24 and 26, the size (e.g., diameter) of the bore extending through the first end is configured to receive the fastener 549 and the size of the bore extending through the second end is configured to receive the fastener 549, the shoulder of the valve stem 560, and the adapter 570. Accordingly, the size of the bore extending through the first end may be smaller compared to the size of the bore extending through the second end.

The adapter 570 may be coupled to the first stem driver 510 and to the valve stem 560. According to an exemplary embodiment, the adapter 570 is generally cylindrically shaped having an outer surface, which is configured to be coupled to an inner surface of the first stem driver 510, and an inner surface, which is configured to be coupled to an outer surface of the valve stem 560. Each of the inner and outer surfaces of the adapter 570 may include a feature to couple the adapter 570 to the valve stem 560 and the first stem driver 510, respectively. For example, the inner surface of the adapter 570 may include splines that are configured to couple to mating splines on the outer surface of the shoulder of the valve stem 560. Also for example, the outer surface of the adapter 570 may include splines that are configured to couple to mating splines on the inner surface of the first stem driver 510. The splines may provide a snap-fit connection between the adapter 570 and the valve stem 560 and the first stem driver 510, respectively.

The fastener 549 (e.g., screw) may be used in place of or in addition to the adapter 570 to couple the first stem driver 510 to the valve stem 560. As shown in FIGS. 24 and 26, the fastener 549 includes a shaft and a head. The shaft of the fastener 549 is configured to extend through the bore in the first end of the first stem driver 510 to thread to the fluid control valve. According to one example, the fastener 549 threads to an inner surface of the valve stem 560. Thus, the inner surface of the bore of the valve stem 560 may be threaded to couple to the fastener 549. According to another example, the fastener 549 threads to the first actuator of the fluid control valve. The head of the fastener 549 may be configured to seat in the bore in the first end of the first stem driver 510. For example, the bore in the first end may include a feature (e.g., countersink, counterbore, etc.) that receives the head and limits the axial travel of the fastener 549 to secure the first stem driver 510 in place.

Figure 25:
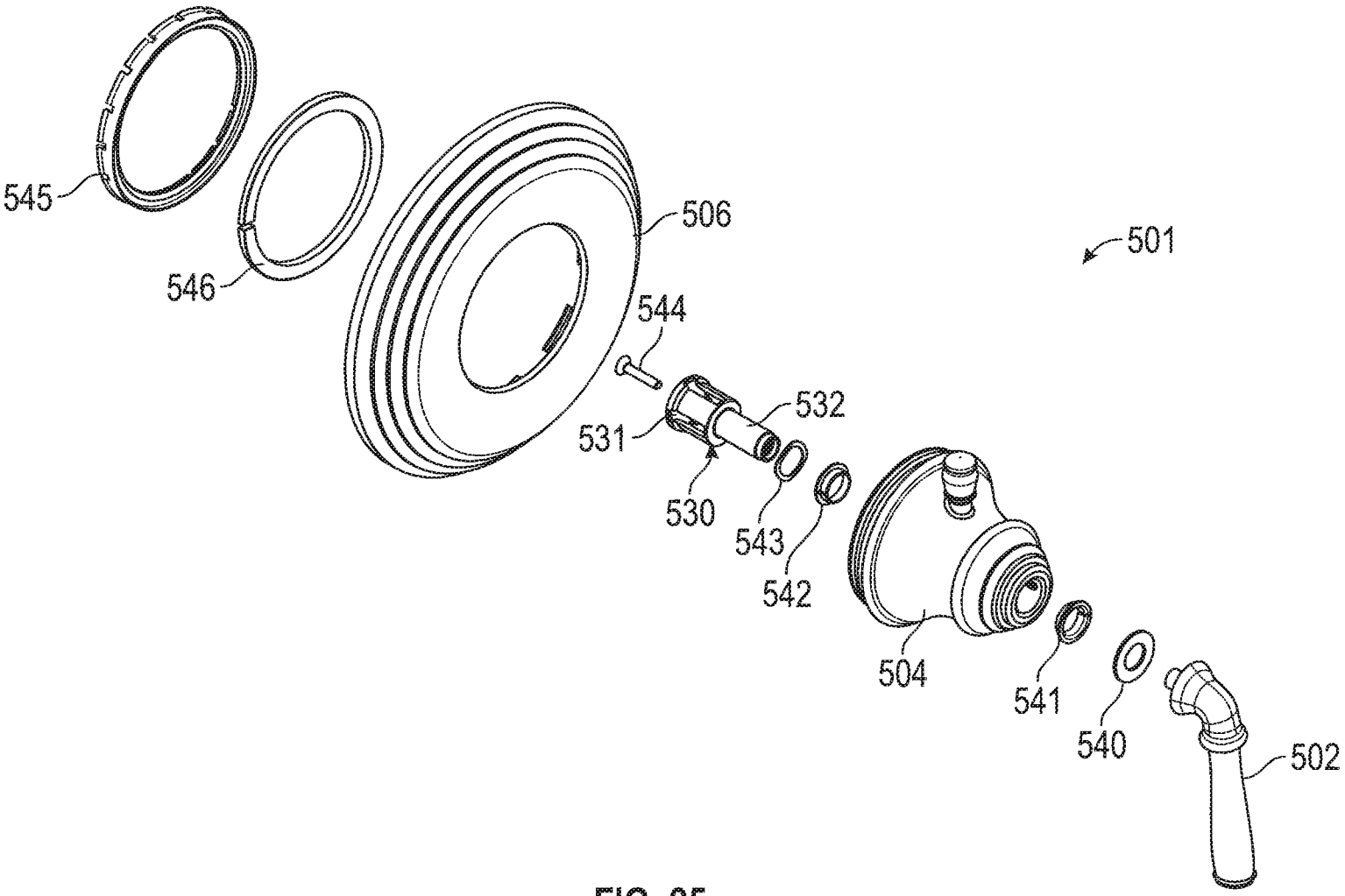
FIG. 25 is an exploded perspective view of the trim system shown in FIG. 24.

As shown best in FIG. 25, the trim assembly 501 includes a first handle 502, a second handle 504, an escutcheon 506, and the cage 530. The first handle 502 may be configured the same as the first handle 202, except where noted. The second handle 504 may be configured the same as the second handle 204, except where noted.

As shown, the second handle 504 includes a knob 505 that is coupled to a base of the second handle 504. The knob 505 is configured to allow a user of the fluid control valve and trim system 500 to rotate the second handle 504 by moving the knob 505. The knob 505 includes a body, which a user can grab, and a threaded post that extends from the body and is configured to thread to a threaded bore in the base of the second handle 504. The second handle 504 includes a shoulder on the end opposite the first handle 504 that is configured to be coupled to the escutcheon 506. The second handle 504 includes a bore that is configured to receive various elements of the fluid control valve and trim system 500, such as, for example, a portion of the fluid control valve, the first stem driver 510, a second stem driver 550, the valve stem 560, the fastener 549, as well as other elements shown in FIG. 24. Disposed in the bore of the second handle 504 are one or more channels (e.g., flutes, grooves, etc.) that are configured to receive one or more lugs on the second stem driver 550. According to one example, a plurality of axially extending and radially aligned channels are provided in a portion of the inner surface of the second handle 504 that defines the bore. Thus, each channel extends in a direction that is parallel to the axis of the rotation of the second handle 504, and each channel is aligned radially from the axis of the rotation. Each channel of the second handle 504 receives one lug extending outwardly from the second stem driver 550, such that rotation of the second handle 504 in-turn rotates the second stem driver 550 through the one or more channels and lugs.

The trim assembly 501 may also include a retainer 545 and a ring 546. As shown in FIG. 24, the ring 546 is configured to engage a channel (e.g., groove, etc.) disposed in an end of the second handle 504. The ring 546 may be generally annular shaped, such as shown in FIG. 25. The ring 546 may have a radially extending notch that extends through the thickness of the ring 546, such that the ring 546 is a split ring. The ring 546 is configured to align (e.g., locate) the trim assembly 501 to the valve (e.g., fluid control valve). For example, the ring 546 ensures that when the mounting bracket is coupled to the wall, the trim assembly 501 is properly aligned to the valve to eliminate (or greatly reduce) any side loading on the valve. Thus, the side loads are transferred to the wall 10 rather than to the plumbing system (e.g., the valve), thereby reducing loading on the plumbing system, which in turn reduces the potential for leaks and improves both the durability and the longevity of the fluid control valve.

The retainer 545 is configured to secure the ring 546 (and, therefore, the second handle 504) to the escutcheon 506. As shown in FIG. 24, the retainer 545 includes a cylindrically shaped body and an inwardly extending wall that forms a lip that is configured to retain the ring 546 at a first end of the retainer 545 by a portion of the body and the lip. The retainer 545 includes a feature that couples the retainer 545 to the escutcheon 506. According to one example, the retainer 545 includes threads that thread to the escutcheon 506. As shown in FIG. 25, the retainer 545 includes a plurality of tabs disposed at a second end (opposite the first end) that are configured to engage a notch or recess in a wall of the escutcheon 506 to detachably couple the retainer 545 to the escutcheon 506. Each tab may be configured as a detent, such as, for example, having a wedge shape that extends outwardly from an outer diameter (e.g., of the first end and the second end, other than where the tabs extend beyond the outer diameter). The tab may engage a similarly shaped recess in the wall of the escutcheon 506 to secure the retainer 545 in place thereto.

Figure 27:
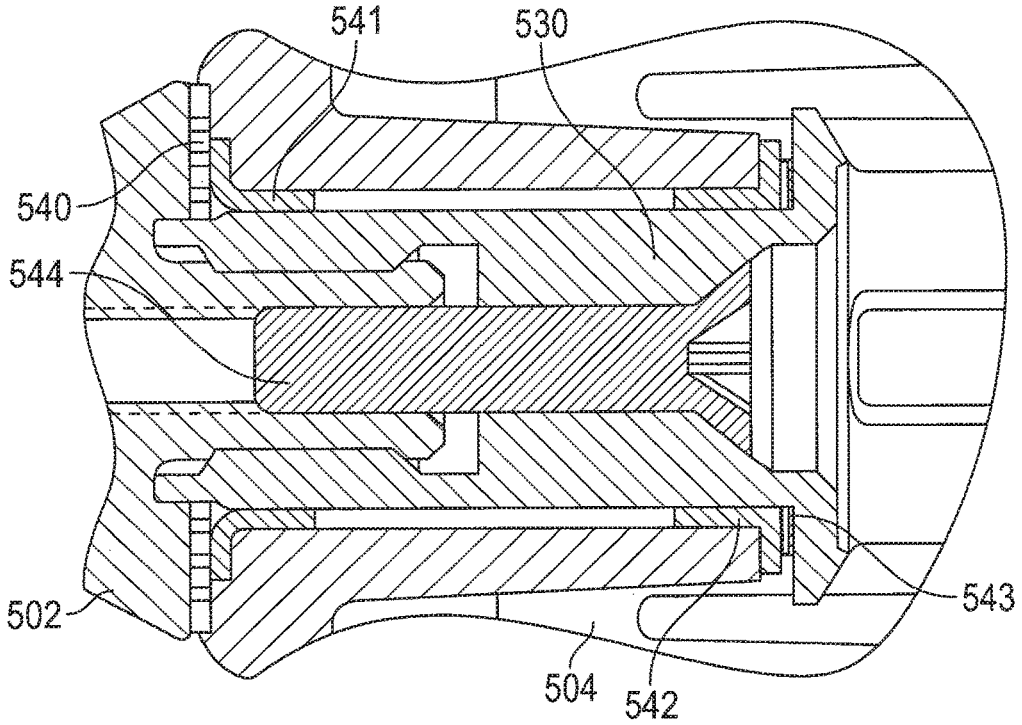
FIG. 27 is another detail view of a portion the fluid control valve and trim system shown in FIG. 24.

The trim assembly 501 may also include one or more bearing, such as to allow low friction rotation between one or more other components of the assembly. As shown in FIGS. 25 and 27, the trim assembly 501 includes a thrust washer 540 and a bearing 541 (e.g., a first bearing) disposed between the first handle 502 and the second handle 504 to facilitate relative rotation therebetween. The thrust washer 540 may be annular in shape and disposed between the bearing 541 and the first handle 502. The bearing 541 may have an annular shaped base and a cylindrically shaped leg that extends from an end of the base. The base of the bearing 541 may be disposed between the thrust washer 540 and the second handle 504, and the leg of the bearing 541 may be disposed between the cage 530 and the second handle 504.

Also shown in FIGS. 25 and 27, the trim assembly 501 includes a second bearing 542 and a spring washer 543 disposed between the cage 530 and the second handle 504 to facilitate relative rotation therebetween. The second bearing 542 may have an annular shaped base and a cylindrically shaped leg that extends from an end of the base. The base of the second bearing 542 may be disposed between the spring washer 543 and the second handle 504, and the leg of the second bearing 542 may be disposed between the cage 530 and the second handle 504. The spring washer 543 may be disposed between a shoulder of the cage 530 and the second bearing 542. The spring washer 543 may be configured to impart a force that biases the second bearing 542 and the cage 530 away from one another (e.g., in an axial direction). This arrangement may advantageously remove any looseness (e.g., gaps) between the components of the trim assembly 501, such as between the second handle 504 and the first handle 502, since the second handle 504 is biased toward the first handle 502.

Also shown in FIGS. 24, 25, and 27, a fastener 544 (e.g., a screw) is provided to couple the cage 530 to the first handle 502. As shown, the cage 530 includes a first portion 531 and a second portion 532. The first portion 531 includes a sidewall having a plurality of slots, similar to that of the cage 230 described above. Each slot of the first portion 531 of the cage 530 receives one lug of the first stem driver 510 to rotatably couple the cage 530 and the first stem driver 510. The second portion 532 of the cage 530 extends from an end of the first portion 531 toward the first handle 502. The second portion 532 is generally cylindrically shaped having a bore that is configured to receive the fastener 544. As shown in FIGS. 24 and 27, a distal end (relative to the first portion 531) of the second portion 532 receives a shoulder of the first handle 502 in the portion of the bore in the distal end, such that the fastener 544 threads to the shoulder to secure the first handle 502 to the cage 530. The portion of the bore in the end of the second portion 532 adjacent to the first portion 531 may include a countersink, counterbore, or other suitable feature to receive and capture the head of the fastener 544.

As shown in FIG. 25, the trim assembly 501 may be assembled by placing the second bearing 542 and the spring washer 543 over the second portion 532 of the cage 530, such that they bear against the shoulder of the first portion 531 of the cage 530. The second bearing 542, the spring washer 543, and the cage 530 may then be inserted into the second handle 504, such that a portion of the distal end of the second portion 532 of the cage 530 extends beyond the second handle 504. The thrust washer 540 and the bearing 541 may then be disposed over the distal end of the second portion 532 of the cage 530 between the first and second handles 502, 504. The first handle 502 may be pressed onto the cage 530, such that the shoulder of the first handle 502 engages the bore in the distal end of the second portion 532 of the cage 530. The fastener 544 may then be inserted into the bore in the first portion 531 of the cage 530 and threaded to the first handle 502 to couple a first subassembly of the trim assembly 501 together. The first subassembly of the trim assembly 501 may then be coupled to the escutcheon 506 by inserting an end of the second handle 504 into a central opening in the escutcheon 506, such that a groove in the end of the second handle 504 is accessible from behind (e.g., the backside of) the escutcheon 506. The ring 546 may be snapped into the groove in the end of the second handle 504, and then the retainer 545 may be placed over the ring 546 and secured to the escutcheon 506, such as, for example, by way of snap-fitting the tabs of the retainer 545 into recesses in the escutcheon 506. The finished trim assembly 501 may then be assembled to the fluid control valve, such as, for example, by detachably coupling the escutcheon 506 to a mounting plate of the system, the valve body of the system, or other suitable element of the system.

Figure 28:
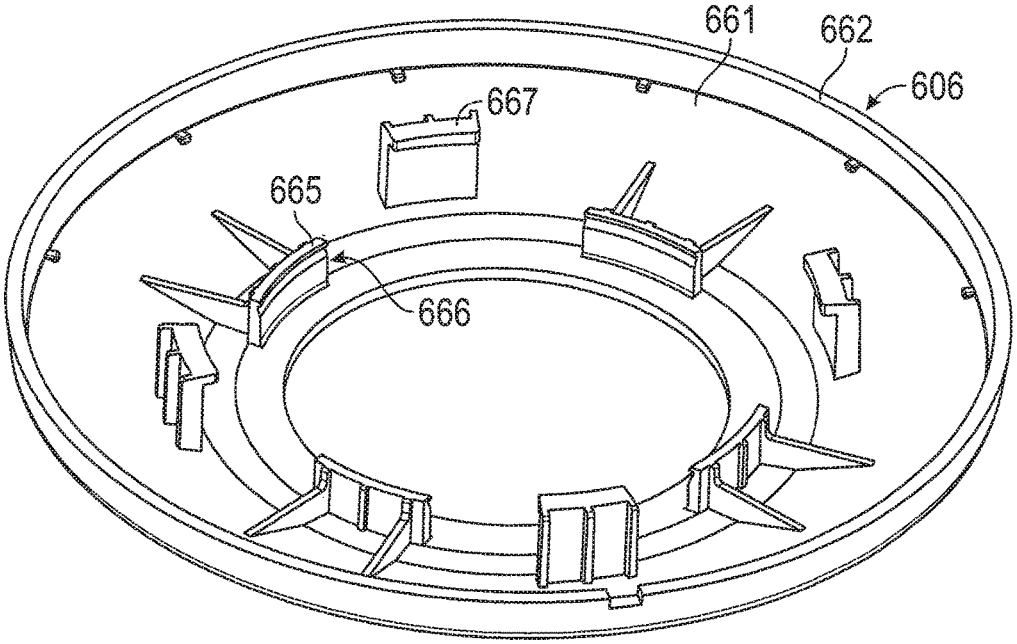
FIG. 28 is a perspective view of an exemplary embodiment of an escutcheon for use with a fluid control valve and trim system, such as the system shown in FIG. 24.
Figure 29:
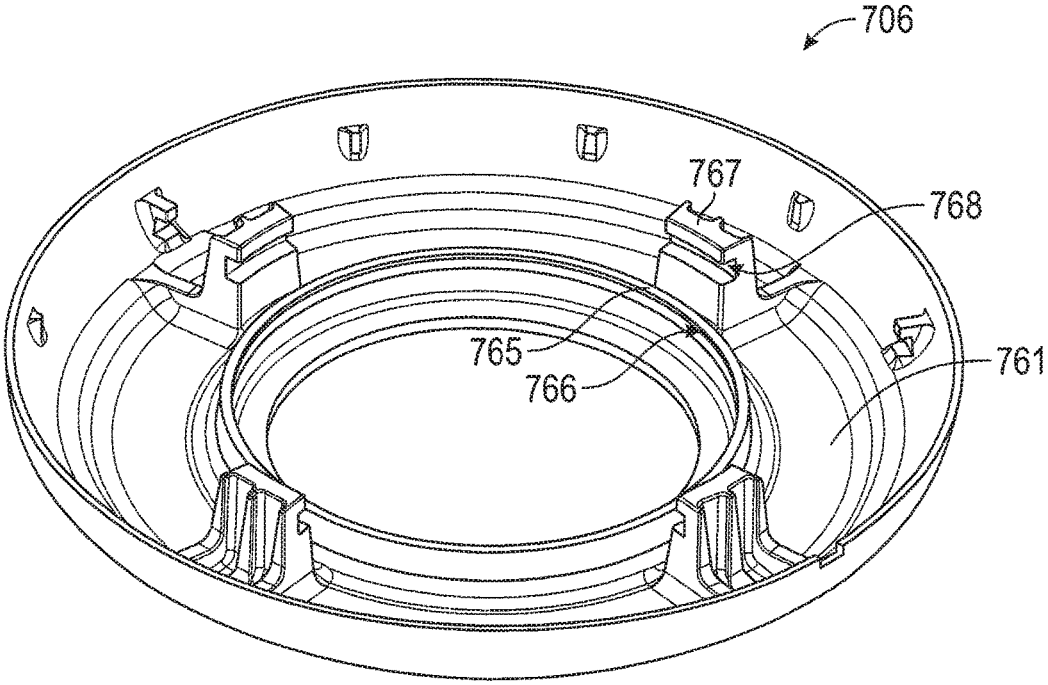
FIG. 29 is a perspective view of another exemplary embodiment of an escutcheon for use with a fluid control valve and trim system, such as the system shown in FIG. 24.
Figure 30:
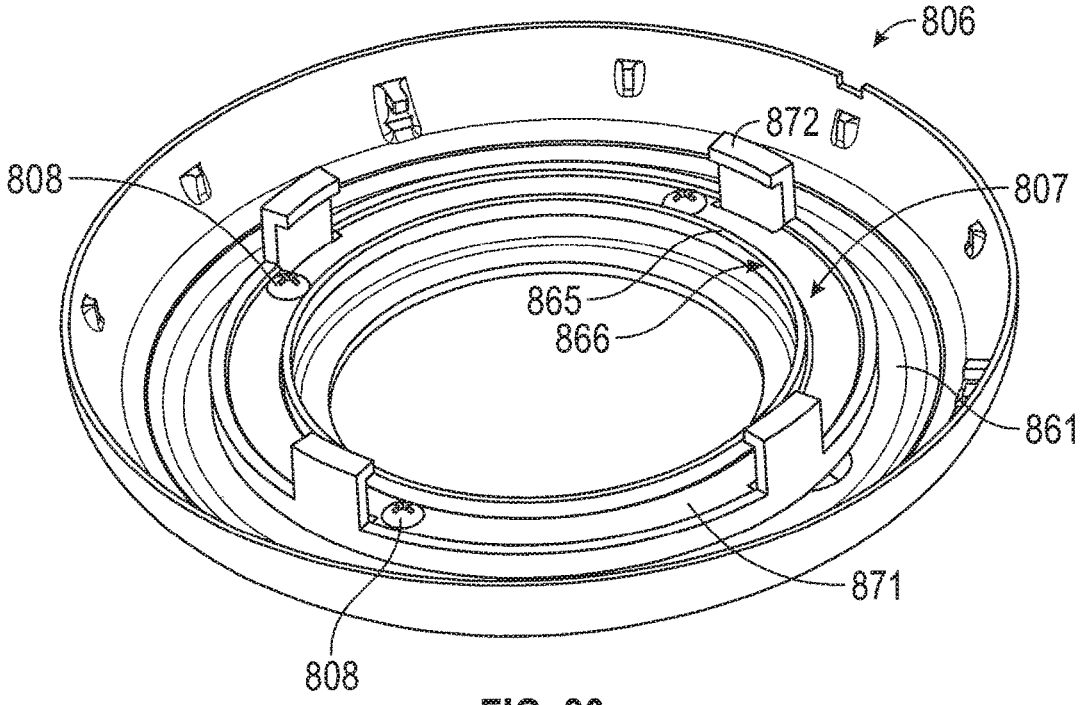
FIG. 30 is a perspective view of yet another exemplary embodiment of an escutcheon for use with a fluid control valve and trim system, such as the system shown in FIG. 24.

FIGS. 28-30 illustrate exemplary embodiments of escutcheons 606, 706, 806 for use with a fluid control valve and trim system, such as the systems shown in FIGS. 1, 2, and 24. The embodiments of FIGS. 28 and 29 are configured as one-piece escutcheons 606, 706. The embodiment of FIG. 30 is configured as a two-piece escutcheon 806.

As shown in FIG. 28, the escutcheon 606 is a one-piece escutcheon that is made from a plastic, polymer, composite or other suitable material. The escutcheon 606 includes a base 661 and a wall 662 extending from an inside of the base 661. The base 661 has a central opening that is configured to receive other elements of the trim assembly (e.g., the trim assembly 501), such as to operatively couple the handles of the system to the fluid control valve. The base 661 may include a first coupling feature that is configured to couple the escutcheon 606 to the retainer (e.g., the retainer 545). As shown, the base 661 includes a plurality of first coupling features 665 that are spaced apart circumferentially around the central opening. Each first coupling feature 665 includes a semi-circular wall that extends generally perpendicular to the portion of the base 661 surrounding the central opening. Provided in the wall of each first coupling feature 665 is a recess 666 that is configured to receive a tab (e.g., detent) of the retainer 545 to couple the retainer 545 to the escutcheon 606. The recess 666 may have a shape that complements the shape of the tab, such as, for example, a generally triangular shape, a semi-circular shape, C-shaped, or other suitable shape. The base 661 may also include a second coupling feature that is configured to couple the escutcheon 606 to a mounting bracket or other element of the system. As shown, the base 661 includes a plurality of second coupling features 667 that are spaced apart circumferentially around the central opening. Each second coupling feature 667 includes a semi-circular wall that extends away from the base 661 and a lip that extends radially inward from a distal end of the second coupling feature 667 relative to the base 661. The lip of each second coupling feature 667 may be configured as a bayonet that engages an opening in a component of the system (e.g., a mounting bracket) to secure the two elements together. For example, upon relative rotation between the escutcheon 606 and the mounting bracket, the lip is retained by a mating lip of the mounting bracket.

As shown in FIG. 29, the escutcheon 706 is a one-piece escutcheon that is made from a metal (e.g., brass, aluminum, etc.), composite, or other suitable material. The escutcheon 706 includes a base 761 having a central opening that is configured to receive other elements of the trim assembly (e.g., the trim assembly 501). The escutcheon 706 may include a first coupling feature 765 that is configured to couple the escutcheon 706 to the retainer (e.g., the retainer 545). As shown, the first coupling feature 765 is an annular ring that extends inwardly from the base 761. The first coupling feature 765 includes a recess 766 that is configured to receive a tab (e.g., detent) of the retainer 545 to couple the retainer 545 to the escutcheon 706. The recess 766 may have any suitable shape, which may complement the shape of the detent of the retainer. The escutcheon 706 may include a second coupling feature that is configured to couple the escutcheon 706 to a mounting bracket or other element of the system. As shown, the base 761 includes a plurality of second coupling features 767 that are spaced apart circumferentially around the central opening. Each second coupling feature 767 is a semi-annular wall that extends away from the inside surface of the base 761, and a recess 768 (e.g., groove, channel) is provided in the wall. As shown, each recess 768 has a C-shape and extends radially into the wall through the inner diameter surface. The recess 768 is configured to receive a portion of the mounting bracket to secure the escutcheon 706 to the mounting bracket.

As shown in FIG. 30, the escutcheon is a two-piece escutcheon including an outer part 806 and an inner part 807. The outer part 806 includes a base 861 having a first coupling feature 865 extending therefrom. The first coupling feature 865 may, for example, be configured the same as the first coupling feature 765 (e.g., having a recess 866). The inner part 807 is coupled to the outer part 806 through, for example, one or more fasteners 808 (e.g., screws). The inner part 807 includes an annular ring 871 having one or more second coupling features 872 extending from the ring 871. Each of the second coupling features 872 may be configured the same as the second coupling features of the escutcheons 606, 706. For example, each second coupling feature 872 may be a bayonet style tab that engages a mating receiving member in the mounting bracket.

The construction and arrangement of the elements of the trim system as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A method for installing a trim system for use with a kitchen or bath fixture, the method comprising: positioning a locating ring against a trim assembly, the locating ring having an adhesive layer on a rear surface thereof; coupling the trim assembly to a fluid control valve mounted behind a wall; pushing the trim assembly and locating ring toward the wall to bond the adhesive layer of the locating ring to the wall; removing the trim assembly from the locating ring after the locating ring is adhesively bonded to the wall; coupling a mounting bracket to the locating ring, such that a portion of the mounting bracket extends through an opening of the locating ring toward the fluid control valve; securing the mounting bracket to the wall; and coupling the trim assembly to the mounting bracket.

2. The method of claim 1, further comprising coupling a stem driver to the fluid control valve, wherein coupling the trim assembly to the fluid control valve comprises coupling the trim assembly to the stem driver.

3. The method of claim 2, further comprising selecting the stem driver from a plurality of stem drivers based on a distance between the fluid control valve and a handle of the trim assembly.

4. The method of claim 1, further comprising removing a protective layer from the adhesive layer on the locating ring, wherein the locating ring is repositionable on the wall.

5. The method of claim 1, further comprising aligning the mounting bracket before securing the mounting bracket to the wall.

6. A method for installing a trim system for use with a kitchen or bath fixture, the method comprising:

providing a trim assembly and a locating ring, the locating ring having an adhesive layer;

coupling the locating ring to a wall using the adhesive layer;

coupling the mounting bracket to the locating ring and the wall, such that a flange of the mounting bracket is received in an opening of the locating ring that is defined by a ridge of the locating ring;

securing the mounting bracket to the wall using an anchor, such that the locating ring is located between the mounting bracket and the wall; and coupling the trim assembly to the mounting bracket.

7. The method of claim 6, wherein the mounting bracket is secured to the wall using a plurality of anchors, each anchor being rotatable relative to the mounting bracket and the wall about a rotational axis to move between a locking position behind the wall and a non-locking position not behind the wall.

8. The method of claim 7, wherein a mounting screw is associated with each anchor, such that rotation of the mounting screw in a first direction moves the associated anchor along the rotational axis relative to the mounting bracket to clamp the wall between the anchor and the mounting bracket.

9. The method of claim 6, wherein coupling the trim assembly to the mounting bracket comprises:

inserting in an axial direction at least one finger of the trim assembly into at least one corresponding slot in the mounting bracket; and rotating the trim assembly relative to the mounting bracket in a direction transverse to the axial direction to a lock position, such that the trim assembly is prevented from substantially moving in the axial direction relative to the mounting bracket.

10. The method of claim 9, wherein the at least one finger of the trim assembly comprises a plurality of semi-circular fingers, and each semi-circular finger engages an associated semi-circular slot in the mounting bracket in the lock position.

11. The method of claim 6, further comprising:

coupling a first stem driver to the fluid control valve;

coupling a cage to the first stem driver;

coupling a second stem driver to the fluid control valve, such that the cage and the first stem driver are disposed in a bore of the second stem driver;

coupling a first handle to the cage; and coupling a second handle to the second stem driver.

12. The method of claim 11, further comprising:

locating a first bearing is between the first handle and the second handle; and locating a second bearing is between the cage and handle;

wherein the first stem driver and the cage are configured to compensate for axial and angular misalignment between the first handle and a first actuator of the fluid control valve, and the second stem driver and the second handle are configured to compensate for axial and angular misalignment between the second handle and a second actuator of the fluid control valve.

13. The method of claim 11, further comprising threading a retainer to an escutcheon to retain a split ring between the retainer and the escutcheon, wherein the second handle has a groove that receives the split ring to couple the second handle and the split ring together and to facilitate rotation of the second handle relative to the escutcheon, and wherein the escutcheon is detachably coupled to the mounting bracket.

14. The method of claim 11, wherein the second stem driver includes radially outward extending lugs, each lug engages an associated channel in the second handle, such that rotation of the second handle about an axis of rotation drives rotation of the second stem driver while allowing relative movement between the second handle and the second stem driver along the axis of rotation.

15. The method of claim 6, wherein the mounting bracket includes radially outward extending teeth configured to engage radially inward extending teeth of the locating ring to prevent relative rotation between the locating ring and the mounting bracket once installed.

16. A method for installing a trim system for use with a kitchen or bath fixture, the method comprising:

positioning a locating ring against a trim assembly, the locating ring having an adhesive layer on a rear surface thereof;

coupling the trim assembly to a fluid control valve mounted behind a wall;

pushing the trim assembly and locating ring toward the wall to bond the adhesive layer of the locating ring to the wall;

removing the trim assembly from the locating ring;

coupling a mounting bracket to the locating ring;

securing the mounting bracket to the wall;

coupling the trim assembly to the mounting bracket; and coupling a cage and a first handle together to trap a bearing and a second handle between the cage and the first handle.

17. The method of claim 16, wherein coupling the trim assembly to the mounting bracket comprises:

inserting in an axial direction a plurality of fingers of the trim assembly into corresponding slots in the mounting bracket; and rotating the trim assembly relative to the mounting bracket about the axial direction to a lock position, such that the trim assembly is prevented from moving along the axial direction relative to the mounting bracket.

18. A method for installing a trim system for use with a kitchen or bath fixture, the method comprising:

positioning a locating ring against a trim assembly, the locating ring having an adhesive layer on a rear surface thereof;

coupling the trim assembly to a fluid control valve mounted behind a wall;

pushing the trim assembly and locating ring toward the wall to bond the adhesive layer of the locating ring to the wall;

removing the trim assembly from the locating ring;

coupling a mounting bracket to the locating ring;

securing the mounting bracket to the wall; and coupling the trim assembly to the mounting bracket;

wherein coupling the mounting bracket to the locating ring includes providing a seal between the mounting bracket and the locating ring, such that the seal extends circumferentially around a radially outer side of a ridge of the locating ring.

19. The method of claim 18, wherein the seal is disposed between an outer flange surface of the locating ring and an inner flange surface of the mounting bracket.

20. A method for installing a trim system for use with a kitchen or bath fixture, the method comprising:

positioning a locating ring against a trim assembly, the locating ring having an adhesive layer on a rear surface thereof;

coupling the trim assembly to a fluid control valve mounted behind a wall;

pushing the trim assembly and locating ring toward the wall to bond the adhesive layer of the locating ring to the wall;

removing the trim assembly from the locating ring;

coupling a mounting bracket to the locating ring;

securing the mounting bracket to the wall;

coupling the trim assembly to the mounting bracket;

coupling a stem driver to the fluid control valve, wherein coupling the trim assembly to the fluid control valve comprises coupling the trim assembly to the stem driver;

coupling a cage to the first stem driver;

coupling a second stem driver to the fluid control valve, such that the cage and the first stem driver are disposed in a bore of the second stem driver;

coupling a first handle to the cage; and coupling a second handle to the second stem driver;

wherein the first stem driver and the cage are configured to compensate for axial and angular misalignment between the first handle and a first actuator of the fluid control valve, and the second stem driver and the second handle are configured to compensate for axial and angular misalignment between the second handle and a second actuator of the fluid control valve.

* * * * *